United States Patent [19]

Muir et al.

[11] Patent Number: 4,609,334

[45] Date of Patent: Sep. 2, 1986

[54] SCROLL-TYPE MACHINE WITH ROTATION CONTROLLING MEANS AND SPECIFIC WRAP SHAPE

[75] Inventors: Earl B. Muir, Sidney; Russell W. Griffith, Troy; Gerald W. Lilienthal, Sidney, all of Ohio

[73] Assignee: Copeland Corporation, Sidney, Ohio

[21] Appl. No.: 471,743

[22] Filed: Mar. 3, 1983

Related U.S. Application Data

[63] Continuation-in-part of Ser. No. 452,516, Dec. 23, 1982, abandoned.

[51] Int. Cl.[4] ..... F01C 1/04; F01C 21/04

[52] U.S. Cl. ..... 418/55; 418/57; 418/99; 418/150; 464/102

[58] Field of Search ..... 418/55, 57, 99, 150, 418/59, 182; 464/102

[56] References Cited

U.S. PATENT DOCUMENTS

| | | | |
|---|---|---|---|
| 1,780,109 | 10/1930 | Berglund | 418/59 |
| 2,324,168 | 7/1943 | Montelius | 418/55 |
| 2,841,089 | 7/1958 | Jones | 418/55 |
| 3,473,728 | 10/1969 | Vulliez | 418/55 |
| 3,802,809 | 4/1974 | Vulliez . | |
| 3,874,827 | 4/1975 | Young | 418/55 |
| 3,884,599 | 5/1975 | Young et al. . | |
| 3,924,977 | 12/1975 | McCullough . | |
| 3,989,422 | 11/1976 | Guttinger . | |
| 4,141,677 | 2/1979 | Weaver et al. . | |
| 4,157,234 | 6/1979 | Weaver et al. . | |
| 4,303,379 | 12/1981 | Hiraga et al. . | |
| 4,332,535 | 6/1982 | Terauchi et al. . | |
| 4,382,754 | 5/1983 | Shaffer et al. . | |
| 4,403,927 | 9/1983 | Butterworth et al. . | |
| 4,413,959 | 11/1983 | Butterworth . | |
| 4,415,318 | 11/1983 | Butterworth et al. . | |
| 4,441,870 | 4/1984 | Ikegawa et al. . | |
| 4,457,675 | 7/1984 | Inagaki et al. | 418/14 |
| 4,474,543 | 10/1984 | Hiraga et al. . | |
| 4,490,099 | 12/1984 | Terauchi et al. . | |
| 4,496,296 | 1/1985 | Arai et al. . | |

FOREIGN PATENT DOCUMENTS

| | | | |
|---|---|---|---|
| 9350 | 4/1980 | European Pat. Off. . | |
| 12616 | 6/1980 | European Pat. Off. . | |
| 50974 | 5/1982 | European Pat. Off. . | |
| 69531 | 1/1983 | European Pat. Off. . | |
| 2160582 | 6/1973 | Fed. Rep. of Germany . | |
| 1628418 | 7/1977 | Fed. Rep. of Germany . | |
| 59-120794 | 12/1984 | Japan . | |
| 220296 | 1/1925 | United Kingdom | 418/55 |
| 2033476 | 5/1980 | United Kingdom . | |
| 2056566 | 3/1981 | United Kingdom . | |
| 2125900 | 3/1984 | United Kingdom | 418/55 |

*Primary Examiner*—John J. Vrablik

*Attorney, Agent, or Firm*—Harness, Dickey & Pierce

[57] ABSTRACT

There is disclosed a scroll-type machine specifically suited for use as a gaseous fluid compressor. The machine incorporates an improved rotation controlling mechanism which is extremely simple in construction, several embodiments of which are disclosed. This mechanism does not eliminate relative rotation between the scrolls but limits it to a relatively small predetermined amount. Several novel techniques for contouring the profiles of the scroll wrap flanks to give good flank sealing with the aforesaid rotation controlling mechanism are also disclosed, as are two embodiments of an improved scroll drive mechanism and an improved thrust bearing arrangement. A novel method of machining a scroll is also disclosed.

71 Claims, 25 Drawing Figures

FIG. 2.
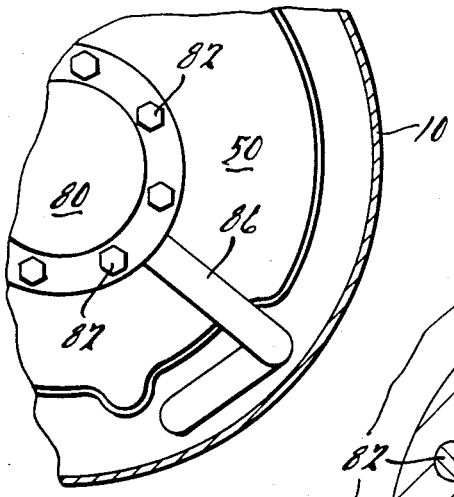
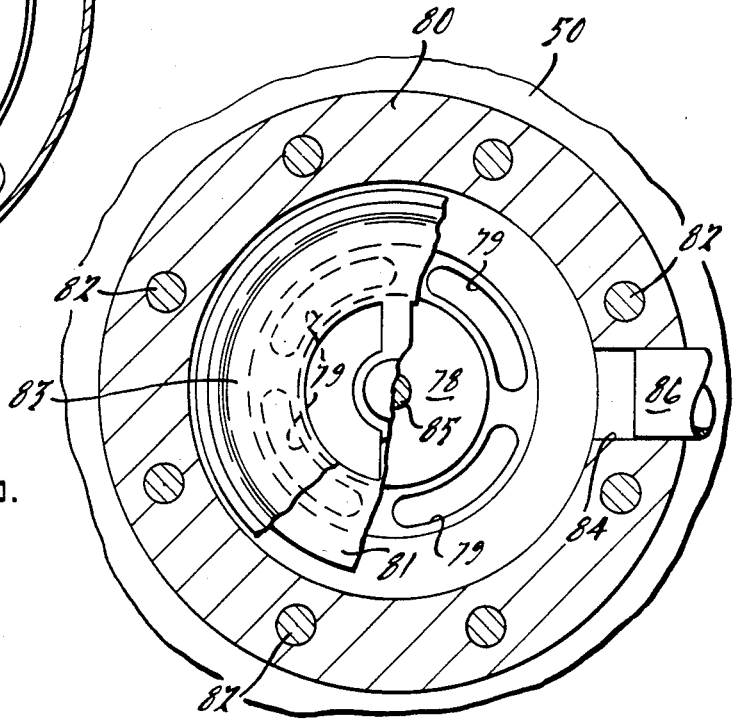
FIG. 3.
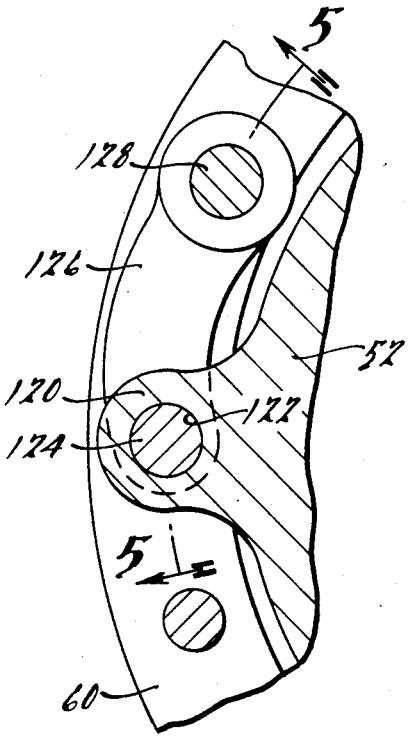
FIG. 4.
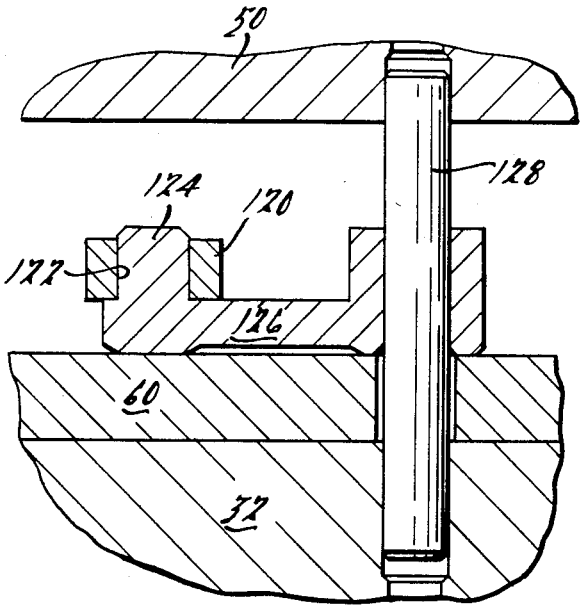
FIG. 5.

FIG. 10.
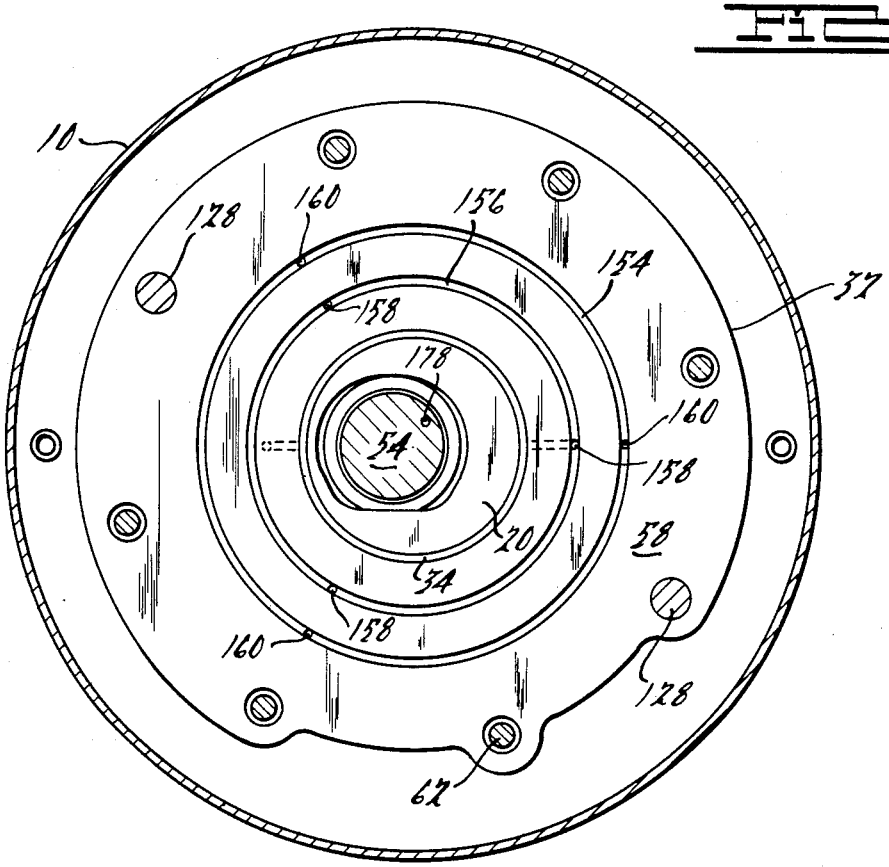
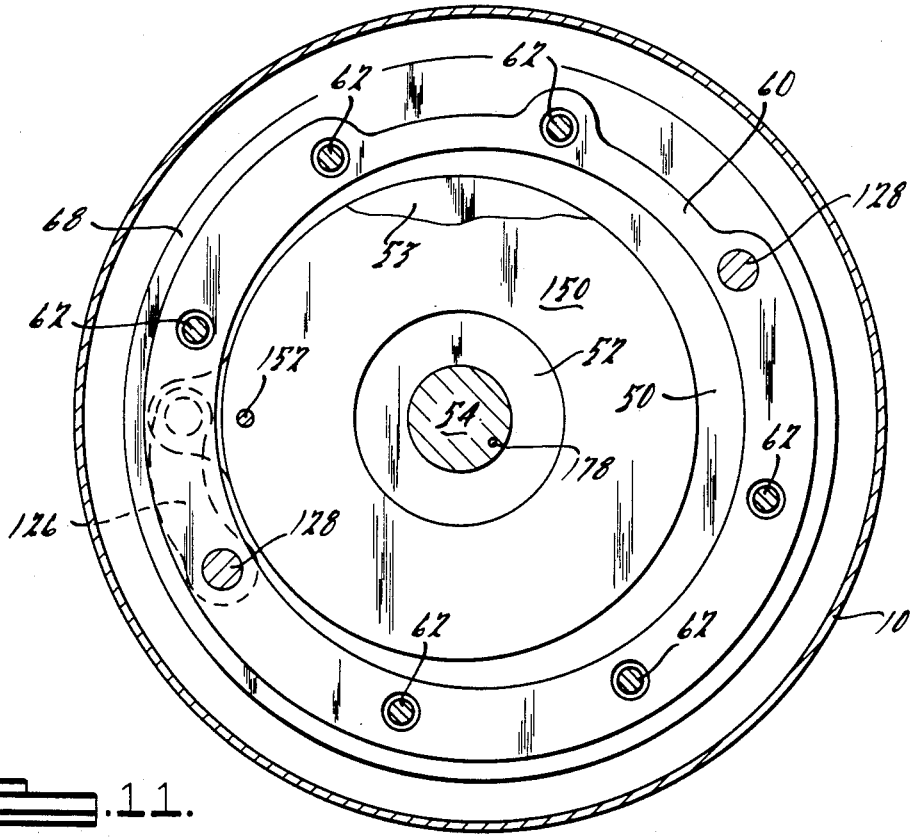
FIG. 11.

SCROLL-TYPE MACHINE WITH ROTATION CONTROLLING MEANS AND SPECIFIC WRAP SHAPE

CROSS-REFERENCE TO RELATED APPLICATION

This application is a continuation-in-part of copending application Ser. No. 452,516, filed Dec. 23, 1982 for SCROLL-TYPE MACHINE, now abandoned.

BACKGROUND AND SUMMARY

The present invention relates to fluid displacement apparatus and more particularly to an improved scroll-type machine especially adapted for compressing gaseous fluids and a method of manufacture thereof.

A class of machines exists in the art generally known as "scroll" apparatus for the displacement of various types of fluids. Such apparatus may be configured as an expander, a displacement engine, a pump, a compressor, etc., and many features of the present invention are applicable to any one of these machines. For purposes of illustration, however, the disclosed embodiments are in the form of a gaseous fluid compressor.

Generally speaking, a scroll apparatus comprises two spiral scroll wraps of similar configuration each mounted on a separate end plate to define a scroll member. The two scroll members are interfitted together with one of the scroll wraps being rotationally displaced 180° from the other. The apparatus operates by orbiting one scroll member (the "orbiting scroll") with respect to the other scroll member (the "fixed scroll") to make moving line contacts between the flanks of the respective wraps defining moving isolated crescent-shaped pockets of fluid. The spirals are commonly formed as involutes of a circle, and ideally there is no relative rotation between the scroll members during operation, i.e., the motion is purely curvilinear translation (i.e. no rotation of any line in the body). The fluid pockets carry the fluid to be handled from a first zone in the scroll apparatus where a fluid inlet is provided, to a second zone in the apparatus where a fluid outlet is provided. The volume of a sealed pocket changes as it moves from the first zone to the second zone. At any one instant in time there will be at least one pair of sealed pockets, and when there are several pairs of sealed pockets at one time, each pair will have different volumes. In a compressor the second zone is at a higher pressure than the first zone and is physically located centrally in the apparatus, the first zone being located at the outer periphery of the apparatus.

Two types of contacts define the fluid pockets formed between the scroll members: axially extending tangential line contacts between the spiral faces of the wraps caused by radial forces ("flank sealing"), and area contacts caused by axial forces between the plane edge surfaces (the "tips") of each wrap and the opposite end plate ("tip sealing"). For high efficiency, good sealing must be achieved for both types of contacts, however, the present invention is primarily concerned with flank sealing. In a conventional scroll compressor (i.e. one in which the wraps are involutes of a circle) good flank sealing requires that there be no relative rotation between the scrolls.

Scroll devices are generally described in any early patent to Creux, U.S. Pat. No. 801,182. Among subsequent representative patents which disclose scroll compressors and pumps are U.S. Pat. Nos. 1,376,291, 2,475,247, 2,494,100, 2,809,779, 2,841,089, 3,560,119, 3,600,114, 3,802,809, 3,817,644, 3,884,599, 4,141,677, 4,300,875, 4,304,535 and 4,357,132.

The concept at a scroll-type apparatus has thus been known for some time and has been recognized as having distinct advantages. For example, scroll machines have high isentropic and volumetric efficiency, and hence are relatively small and lightweight for a given capacity. They are quieter and more vibration free than many compressors because they do not use large reciprocating parts (e.g. pistons, connecting rods, etc.), and because all fluid flow is in one direction with simultaneous compression in plural opposed pockets there are less pressure-created vibrations. Such machines also tend to have high reliability and durability because of the relative few moving parts utilized, the relative low velocity of movement between the scrolls, and an inherent forgiveness to fluid contamination. In spite of this, however, it is believed that the reason use of scroll machines of the prior art has not hitherto become wide spread is because of the difficulty of manufacturing such machines, as well as inherent sealing and unusual wearing problems.

One of the more difficult areas of design in a scroll machine concerns the technique used for preventing relative angular movement between the scrolls as they orbit with respect to one another. One of the more popular approaches resides in the use of an Oldham coupling operative between the orbiting scroll and a fixed portion of the apparatus. An Oldham coupling typically comprises an Oldham ring and two sets of key members or slider blocks. The Oldham ring is formed on one side thereof with grooves which are at right angles to a similar grooves formed on the other side thereof. One set of key members is connected to a surface of the orbiting scroll and is disposed in the grooves on one side of the Oldham ring, while the other set of key members is fixed to either the fixed scroll or the machine housing and is disposed in the grooves on the other side of the Oldham ring. The Oldham ring reciprocates in a motion parallel to the grooves containing the set of key members fixed to the fixed scroll or housing. The Oldham coupling thus acts as a means for controlling (i.e. preventing) angular rotation of the orbiting scroll relative to the fixed scroll, a concept that is believed to be essential to the successful functioning of a conventional scroll apparatus. U.S. Pat. No. 4,121,438 shows a machine of this construction.

Unfortunately, a scroll apparatus utilizing an Oldham coupling possesses several assembly, operational, and maintenance disadvantages, primarily due to the large number of parts that make up the coupling. This large number of parts increases material, manufacturing, and assembly cost. The slider blocks or key members in an Oldham coupling are also all sliding within the grooves on the Oldham ring, thus presenting lubrication and wearing problems. The reciprocating ring is also inherently impossible to balance.

There are other known devices for controlling relative rotation of the scrolls, such as the use of multiple drives rotating both scrolls about different centers, and like concepts; however, because of their complexity these devices also have many of the undesirable features of the Oldham coupling.

The present invention approaches the problem from a different direction. The basic concept of this invention resides in the use of a very simple orbiting scroll rotation controlling device which does not eliminate relative rotation, but simply controls it at a relatively small magnitude, in combination with techniques for easily modifying the contour of the scroll wraps to accommodate the limited relative rotation of the scrolls which occurs, in order to maintain flank sealing contact between the wraps. Three different versions of the rotation controlling device are disclosed, each being a simple linkage operatively connected between the orbiting scroll and a fixed portion of the compressor. Two embodiments are four-bar linkages and two additional embodiments are crank and slider arrangements. All versions couple the orbiting and fixed scrolls in a predetermined angular relationship in all relative positions as the orbiting scroll orbits with respect to the fixed scroll.

The orbiting scroll rotation controlling linkage of the present invention overcomes the aforesaid disadvantages of known techniques for accomplishing this function. Because it has fewer parts, it is less expensive to manufacture and is much easier to assemble. Lubrication problems are also reduced to a minimum because there are fewer connections and in one embodiment because the connections are entirely pivotal, rather than sliding. The anti-rotation member also contains no reciprocating ring.

In order to accommodate for the slight degree of rotation of the orbiting scroll, the present invention utilizes either one of two unique techniques for modifying the scroll wrap contours. Both of them are very easy to implement and provide highly efficient flank sealing (one of them provides theoretically perfect flank sealings) when used in combination with the aforesaid linkage arrangements. A novel wrap machining method is also provided.

The compressor of the present invention also embodies improved drive means for orbiting the scroll which is compact, as well as being simple to manufacture and assemble. This drive means, two embodiments of which are disclosed, provides the necessary contact between the scroll wraps to have efficient wrap sealing while at the same time provides an automatic unloading function in the event slugging or the like occurs. Should a non-compressible fluid be sucked into the compressor the orbiting radius of the orbiting scroll will automatically decrease to permit this fluid to escape between the scroll wraps to an area of less pressure (i.e. the scrolls will simply ride over any liquid). This function is accomplished without extra parts, such as valves or the like, and is very smooth in operation. The drive means is also nested within the upper crankshaft bearing, thereby reducing the axial height of the machine and lessening vibration.

The compressor of this invention also incorporates an improved thrust bearing arrangement to accommodate the axial loading of the orbiting scroll. The thrust bearing takes advantage of the inherent rotating movement of the orbiting scroll to create a squeeze film which provides the oil support for the bearing. The resulting bearing provides significantly less friction than conventional needle bearings and is much less subject to harmful wear than conventionally used balls. Ball-type thrust bearings, especially those with relatively small balls, have such high point loading that they tend to wear excessively. The present bearing is also relatively inexpensive, very simple in design and easy to manufacture and assemble.

Additional advantages and features of the present invention will become apparent from the subsequent description and the appended claims taken in conjunction with the accompanying drawings.

BRIEF DESCRIPTION OF THE DRAWINGS

FIG. 2 is a partial plan view of the top of a portion of the compressor illustrated in FIG. 1;

FIG. 3 is a sectional view taken along line 3—3 in FIG. 1;

FIG. 4 is a sectional view taken along line 4—4 in FIG. 1;

FIG. 5 is a sectional view taken along line 5—5 in FIG. 4;

FIG. 6 is a sectional view taken along line 6—6 in FIG. 1;

FIG. 10 is a sectional view taken along line 10—10 in FIG. 1;

FIG. 11 is a sectional view taken along line 11—11 in FIG. 1;

DETAILED DESCRIPTION OF THE PREFERRED EMBODIMENTS

General Layout

Figure 1:
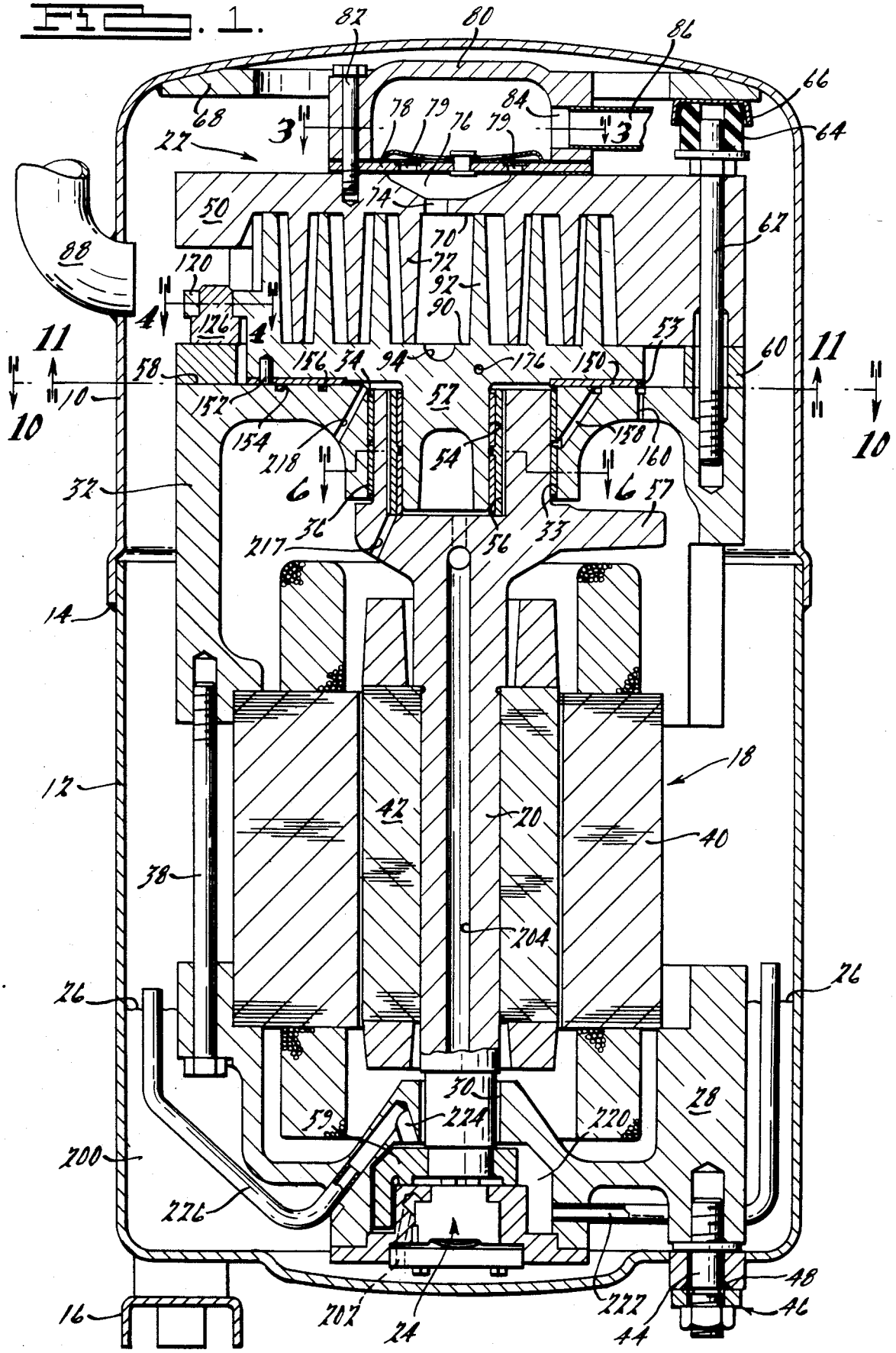
FIG. 1 is a vertical sectional view through a refrigerant compressor embodying the principles of the present invention.

Referring to FIG. 1, there is illustrated an exemplary refrigerant compressor assembly of the hermetic type embodying the principles of the present invention. The compressor is disposed within a hermetic enclosure consisting of an upper shell 10 and a lower shell 12 welded together in the usual manner as at 14. Affixed to the bottom of lower shell 12 are a plurality of feet 16, one of which is shown. The assembly comprises a motor 18 drivingly affixed to a crankshaft 20 which in turn drives a scroll-type compressor 22 connected to the upper end thereof, an oil pump 24 being driven by the lower end of crankshaft 20 to provide lubrication to the machine. Lower shell 12 has a sump of lubricating oil therein, the upper level of which is indicated at 26.

Motor-Compressor Assembly

The motor-compressor assembly comprises a lower bearing housing 28 having a bearing 30 therein in which the lower end of crankshaft 20 is rotationally supported and journaled, and an upper bearing housing 32 defining a bore 33 having spaced sleeve bearings 34 and 36 disposed therein which rotationally support and journal the upper end of crankshaft 20. The bearing housings are affixed to one another by means of a plurality of threaded fasteners 38 which operate to clamp the stator 40 of motor 18 therebetween. Affixed to crankshaft 20 and disposed within the central bore of stator 40 is a rotor 42. The motor is in all respects conventional in design and operation. The motor compressor assembly is mounted within lower shell 12 by means of a plurality of mounting studs 44 (one shown) which are threadably connected to lower bearing housing 28 and are bolted to the bottom of lower shell 12 in the manner best shown at 46. Leakage from the shell is prevented by means of an O-ring 48 sealingly engaging the outer surface of each mounting stud 44.

The compressor, per se, comprises an upper fixed scroll member 50 and a lower orbiting scroll member 52 having a flat lower face 53 and a downwardly extending drive hub 54 disposed within an eccentrically positioned bore 56 in the upper end of crankshaft 20. The end of hub 54 has a recess 55. An upper counterweight 57 is provided on crankshaft 20 adjacent bore 56 to help balance the eccentricity of the drive. The crankshaft has a lower counterweight 59 affixed adjacent the lower end thereof to complete the balancing system, in accordance with known principles. Fixed scroll member 50 is located an accurately predetermined distance above planar upper surface 58 of upper bearing housing 32 by means of a spacer ring 60, and is bolted to housing 32 by means of a plurality of studs 62 which also serve to clamp spacer ring 60 therebetween. The upper end of each stud 62 projects into a nylon spacer 64 disposed within a cup-like element 66 affixed to a mounting ring 68 welded to the top of upper shell 10. In this manner the top of the motor-compressor assembly is mounted to the top of the shell. Although only one is shown, a number of such connections are provided.

Fixed scroll member 50 comprises a planar tip seal surface 70 from which projects a spiral scroll wrap 72. Scroll member 50 is provided with a centrally disposed kidney-shaped discharge opening 74 communicating with a discharge chamber 76 disposed at the upper surface thereof. Chamber 76 is covered by a suitably gasketed valve plate 78 having ports 79 therethrough and being retained in place by means of a cylinder head 80 bolted to the upper surface of scroll member 50 by means of a plurality of threaded fasteners 82. The direction of flow through ports 79 is controlled by a conventional leaf-type check valve 81 which is affixed to valve plate 78, along with the usual backer 83, by means of a rivet 85.

Discharge fluid passes from within cylinder head 80 via an opening 84 in which is disposed one end of a discharge tube 86. Tube 86 extends over the top of the assembly downwardly between the latter and the shell to a point where it exits from the shell in the normal manner (not shown). Suction gas is introduced into the shell in the normal manner via a fitting 88 extending through the wall of upper shell 10. The motor-compressor disclosed herein is of the "low side" type with suction gas present in the hermetic shell for purposes of motor cooling and the like. The gas enters compressor 22 at the periphery of the scroll wraps.

Orbiting scroll 52 comprises a planar tip sealing surface 90 from which projects a spiral scroll wrap 92 adapted to sealingly engage wraps 72 upon relative orbital movement of the scroll members in the usual manner to form fluid pockets of decreasing volume. The tips of wrap 92 are intended to sealingly engage surface 70 of the fixed scroll and the tips of wrap 72 are intended to sealingly engage surface 90 on the orbiting scroll. The central area of orbiting scroll 52 is provided with a kidney-shaped recess 94 to facilitate the flow of discharge fluid. Both wraps 72 and 92 are equally and uniformly tapered in cross-section in order to maximize wrap strength at the root thereof. Discharge opening 74 and recess 94 are configured to provide maximum flow area without weakening the root of the adjacent wraps. Tip seal surfaces 70 and 90 should lie in parallel planes which are parallel to the planes in which the tips of both wraps lie, and which are perpendicular to the rotational axis of crankshaft 20.

Orbiting Drive Means

The drive means of the present invention does not utilize a rigid coupling between the crankshaft and the oribitng scroll, but instead is one which will yield radially to permit automatic unloading of the compressor in the event of ingestion of an incompressible fluid or misalignment of the parts. The drive means relies on centrifugal and driving forces to maintain the flanks of the oribiting scroll in sealing contact with those of the fixed scroll. This is accomplished in a very axially compact manner using an unloader hub 100, as best illustrated in FIGS. 1 and 6–9.

Hub 100 comprises an outer circular cylindrical retainer 102 and axially spaced inner sleeve bearings 104 and 106 in which hub 54 of the orbiting scroll is journaled. Retainer 102 has a flat driven surface 108 on the periphery thereof, surface 108 lying in a plane parallel to the axis of rotation of the crankshaft. Driven surface 108 drivingly engages a complementary flat driving surface 110 in the wall of bore 56, the latter surface being of greater width than the former. Bore 56 is otherwise of sufficient size and shape to permit limited relative tangential sliding between hub 100 and crankshaft 20. The center of rotation of the crankshaft is indicated at cc and the center of the hub and orbiting scroll is indicated at cs. Rotation of crankshaft 20 causes hub 100 to revolve about the axis cc. This in turn causes hub 54, and hence orbiting scroll member 52, to orbit about the axis cc. The radius of the orbit of the orbiting scroll member is determined by the geometry of the wrap profiles (i.e. the engagement of the flanks of the wraps of the orbital scroll member with the flanks of the wraps of the fixed scroll member).

Figure 8:
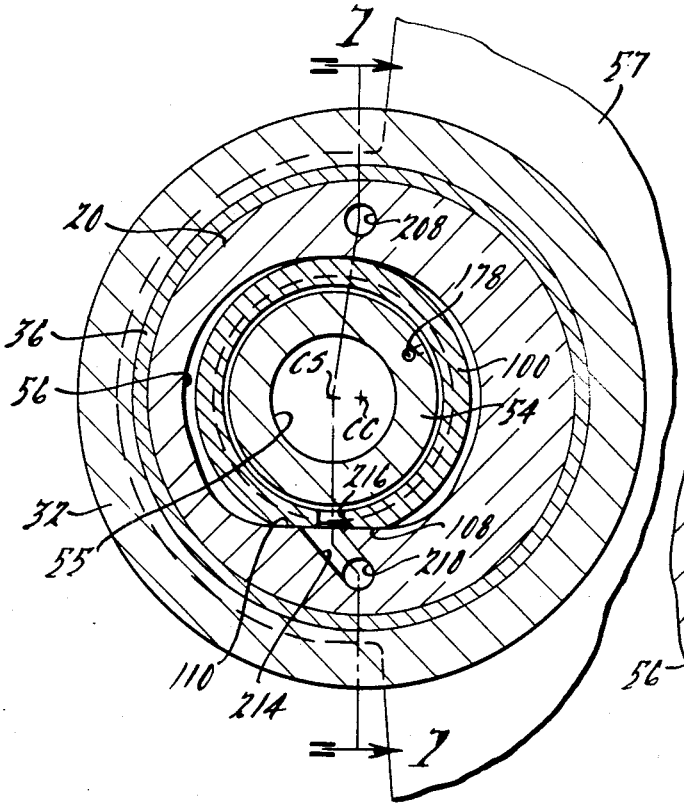
FIG. 8 is an enlarged exaggerated illustration of the orbiting drive means of FIG. 6 showing it in its normal driving position.
Figure 9:
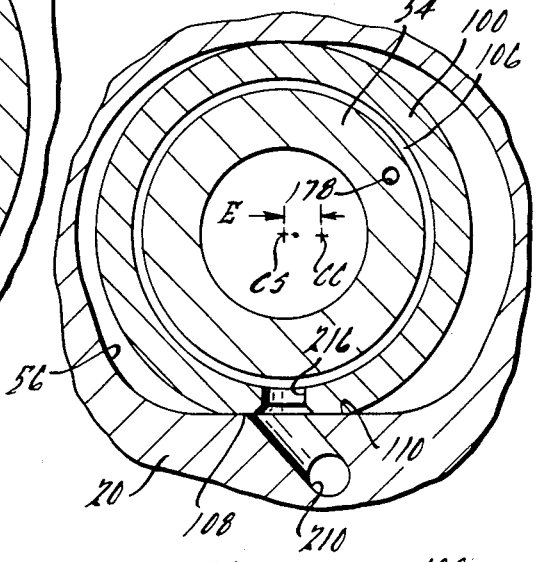
FIG. 9 is a view similar to FIG. 8 but showing the drive means in its unloaded position.

In the event the wraps encounter a slug of incompressible fluid, the forces thereby created tending to separate the wraps will be accommodated by unloader hub 100 sliding from the normal driving position shown in FIGS. 6 and 8 to the exaggerated position shown in FIG. 9. This will permit the wraps to separate and pass over the fluid slug, whereupon centrifugal force will cause the orbiting wrap to move back into sealing engagement with the fixed wrap.

The axially nested relationship of the parts minimizes the axial height of the assembly. Furthermore, it permits locating the upper counterweight very close to the center of mass of the orbiting scroll, which reduces bearing loads and bending forces on the crankshaft, as well as the size of the counterweight required. It also eliminates a cantilevered drive bearing at the top of the crankshaft, which further reduces bearing loads.

Figure 17:
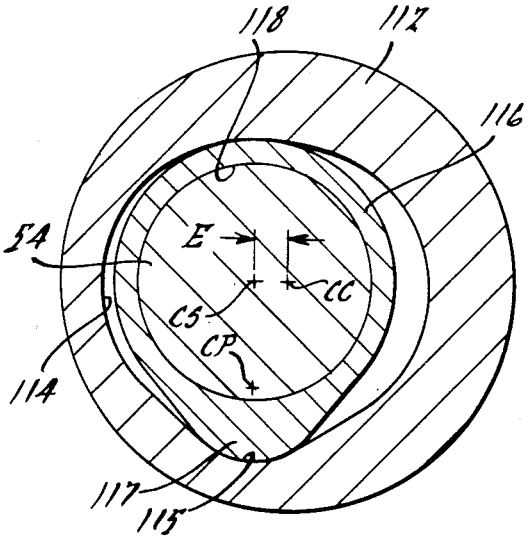
FIG. 17 is a fragmentary horizontal sectional view illustrating a second embodiment of a drive means of the present invention in its normal driving condition.
Figure 18:
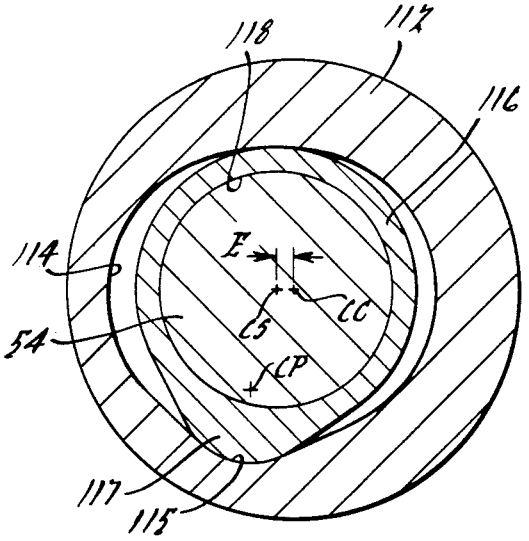
FIG. 18 is a view similar to FIG. 15 but illustrating the drive means in an unloaded condition.

The present invention embodies another unique version of an orbiting drive means which will also give the desired orbital motion and yet still permit automatic unloading of the compressor in the event an incompressible fluid is encountered. This embodiment, illustrated in horizontal section in FIGS. 17 and 18, comprises a crankshaft 112 (having a center of rotation cc) in the upper end of which is disposed an axial bore 114 of the shape illustrated, the significant part of which is a circular cylindrical surface 115 (having a center of radius cp) in which is nested a drive element 116 having a projection 117 of radius equal to that of surface 115. Drive element 116 has a circular bore 118 therethrough (having a center axis cs) in which is journaled hub 54 of the orbiting scroll. Suitable bearings may be provided at the interface of bore 118 and hub 54 if desired. As can be seen, the geometry of the arrangement is such that upon rotation of crankshaft 112 about axis cc centrifugal force will normally maintain the respective parts in the positions shown in FIG. 17, with the orbiting radius being dictated by the geometry of the scroll flanks, as aforesaid. When an unloading situation occurs, however, drive element 116 can rotate about center cp to the position shown in FIG. 18 to permit the wrap flanks to separate to the extent necessary to pass the incompressible matter disposed therebetween.

Rotation Controlling Means

The present invention solves the problem of coupling the scroll members to control relative rotation therebetween in a very simple and unique way. In the embodiment of FIGS. 1 through 13 (see particularly FIGS. 1, 4 and 5), this is accomplished by providing a projection 120 on the outer periphery of orbiting scroll member 52 having an axially extending bore 122 therethrough in which is pivotally disposed a projection 124 at one end of a simple link 126, the opposite end of which is pivotally mounted to any fixed part of the apparatus. In the embodiment illustrated, link 126 is journalled on one of the axially extending locating pins 128 which project into and accurately locate with respect to one another fixed scroll member 50 and upper bearing housing 32. The lower surface of link 126 is flat and slidingly rests upon the flat upper surface of spacer ring 60.

Link 126 is preferably as long as possible (to minimize the effect of the fact that projection 124 will move in an arcuate rather than a straight line path) and should operate as close as reasonably possible to perpendicular to an imaginary line extending between the center of the orbiting scroll member and bore 122. This very simple linkage arrangement replaces the complex Oldham coupling used in known devices. The small degree of relative rotation between the scroll members which this linkage arrangement does permit is accurately controlled and is of a defined magnitude and nature so that it can be readily accommodated without sacrificing performance or efficiency, as will be described hereinbelow.

Figure 13:
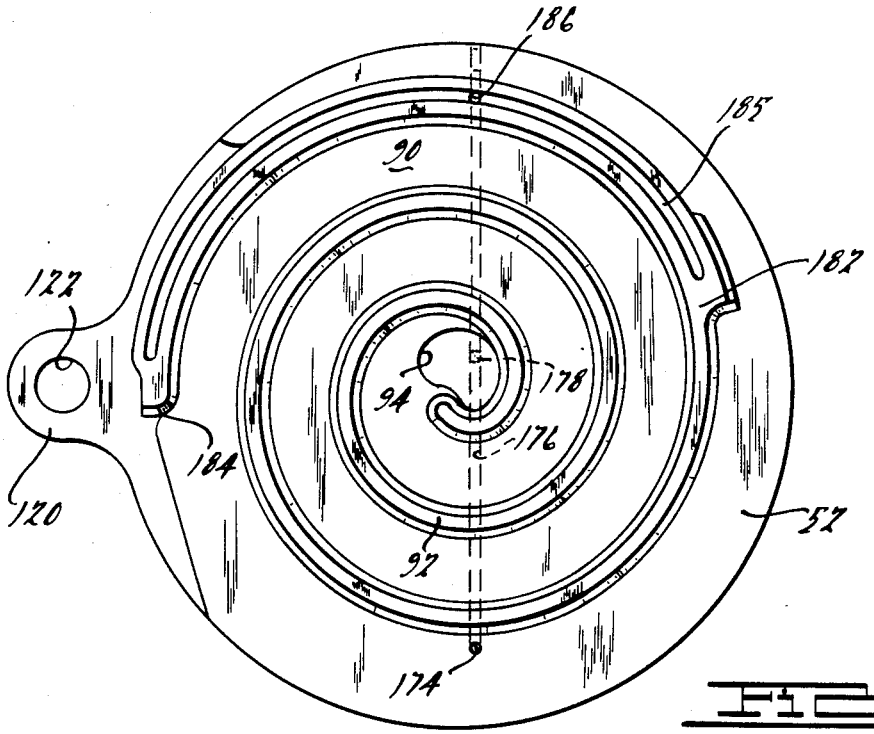
FIG. 13 is a top plan view of the lower orbiting scroll member.
Figure 14:
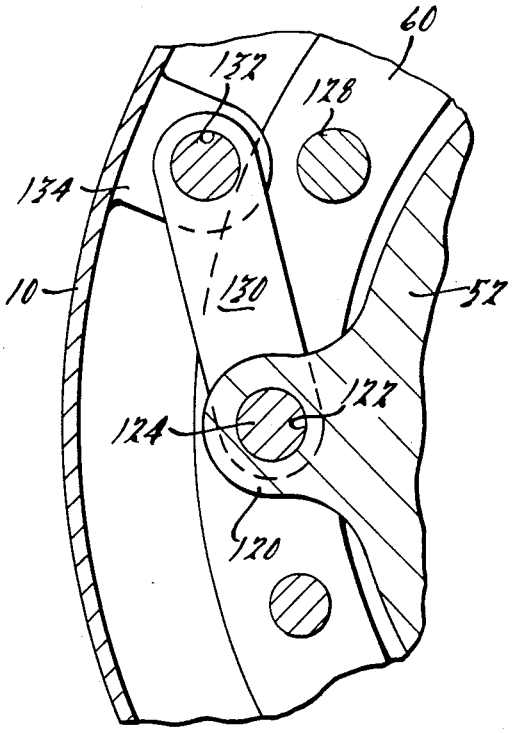
FIG. 14 is a view similar to FIG. 4 showing a second embodiment of the rotation controlling means of the present invention.
Figure 15:
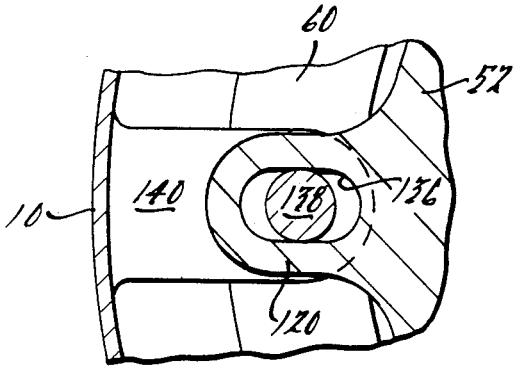
FIG. 15 is a fragmentary horizontal sectional view showing a third embodiment of the rotation controlling means of the present invention.
Figure 16:
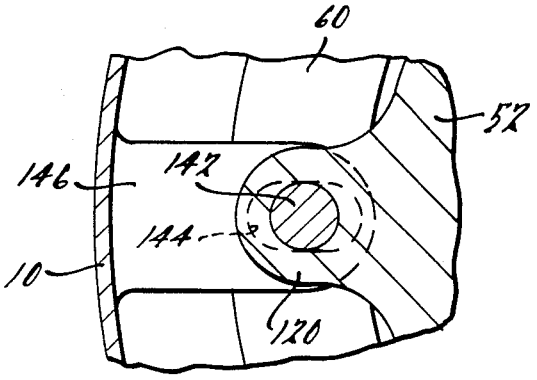
FIG. 16 is a view similar to FIG. 15 illustrating a fourth embodiment of the rotation controlling means of the present invention.

The present invention also embodies other simple linkage arrangements, such as those shown in FIGS. 14–16. The embodiment of FIG. 14 is almost identical to that of FIGS. 1 through 13 except that the simple link is relatively straight, as indicated at 130, and is journalled at its fixed end to a projection 132 mounted upon a bracket 134 rigidly affixed to upper shell 10. The movable end of link 130 is in all respects the same as that described with respect to the preceding embodiments and the function of the two links is the same. Both of these linkage arrangements are known in the art as four-bar linkages. The first "bar" of the linkage is link 126 or 130, which extends from a fixed portion of the structure to the periphery of the orbiting scroll. The second "bar" of the linkage is the imaginary link between the pivot point at the periphery of the orbiting scroll and the geometric center of the scroll. The third "bar" is the imaginary link which extends between the geometric center of the scroll and the center about which the scroll orbits, and the fourth "bar" is the fixed structure which extends from the fixed pivot of the first "bar" to the fixed pivot of the third "bar".

The embodiments of the rotation controlling means illustrated in FIGS. 15 and 16 are both of the crank and slider type. In the embodiment of FIG. 15 projection 120 on orbiting scroll member 52 is provided with a radially extending enlongated slot 136 in which is slidably disposed a pin 138 which is mounted upon a bracket 140 which is rigidly affixed to upper shell 10. In the embodiment of FIG. 16, projection 120 of orbital scroll member 52 has affixed thereto a pin 142 which is slidably disposed within a radially extending elongated slot 144 in a bracket 146 which is affixed to upper shell 10. In both of these last two embodiments, rotation of the orbital scroll member is prevented as a result of the interengagement of pin 138 in slot 136 or pin 142 in slot 144.

Thus, in all four embodiments the rotation of the orbital scroll members is prevented by pivoting it about a single relatively fixed pivot point. The only significant difference between the arrangements is that in the four-bar linkage arrangements the single pivot moves in a slightly arcuate path whereas in the two crank and slider arrangements relative movement of the pivot is in a straight-line path. In addition, in the embodiment of FIG. 15 the imaginary link between the single pivot point and the geometric center of the orbiting scroll varies as the scroll orbits, whereas it is fixed in the other embodiments.

Thrust Bearing

The handling of high thrust loads, which are an inherent characteristic of scroll machinery, is an area which has presented many problems to designers in this field. Applicants have discovered that these thrust loads can be efficiently handled using a bearing which relies on the inherent imbalance of the orbiting scroll member to support the thrust load through a squeeze film mechanism. This bearing has very low friction, is very simple in design, requires only flat finishing, has high stiffness, and because of the low relative speeds encountered has small shear losses. It also transmits the thrust loads directly to the frame of the apparatus (i.e. upper bearing housing 32).

As best shown in FIGS. 1, 10 and 11, the thrust bearing assembly comprises a relatively thin bearing 150 formed of Teflon and lead impregnated bronze, or other suitable bearing material, having opposed parallel flat faces slidably engaging on its lower side flat upper surface 58 of upper bearing housing 32 and on its upper side flat surface 53 on orbiting scroll member 52. Relative movement between bearing 150 and scroll member 52 is prevented by means of a pin 152 which projects into both parts. There are no oil grooves on bearing 150, but instead upper surface 58 of housing 32 is provided with two concentric grooves 154 and 156. Groove 156 is an oil supply groove and is supplied oil via a plurality of passages 158 which communicates through housing 32 to bore 33 in the area of the space between sleeve bearings 34 and 36. Groove 154 is an oil drain groove which permits oil to drain back to the open crankcase defined by housing 32 via a plurality of passages 160, in order to reduce oil carryover into the suction gas entering the compressor. Surfaces 53 and 58 should be parallel to one another and perpendicular to the axis of rotation of crankshaft 20.

It is believed that this bearing functions because the inherent miniscule tilting or wobbling of the orbiting scroll as it orbits creates a rotary oil wave which traverses the entire face of the bearing at a speed determined by the rotational speed of the crankshaft. Thus if the motor is operating at 3600 rpm the relative axial velocity of the parts will cause this wave to traverse the entire face of bearing 150 and surface 58 in a circular path at 3600 rpm. A standard hydrodynamic bearing would not, it is believed, function properly because there is not sufficient relative movement (i.e. high enough tangential velocity) between the scroll and housing because it is only orbital movement of relatively small displacement. Because the bearing of the present invention utilizes a relatively large flat surface, unit loading is relatively small and long bearing life therefore possible.

The thrust loads encountered at the top of the orbiting scroll member are taken by the axial interengagement of the two scroll members; specifically the engagement of the wrap tips on one scroll member with the tip sealing surface on the other scroll member. Fasteners 62 tend to urge the scroll members axially together and the fluid pressures generated by operation of the compressor tends to urge them apart. It is desirable to have sufficient axial force urging the scrolls together, or maintaining them in a sufficiently close relationship, that good tip sealing is achieved. On the other hand, it is desirable to minimize friction and wear as much as possible.

Figure 7:
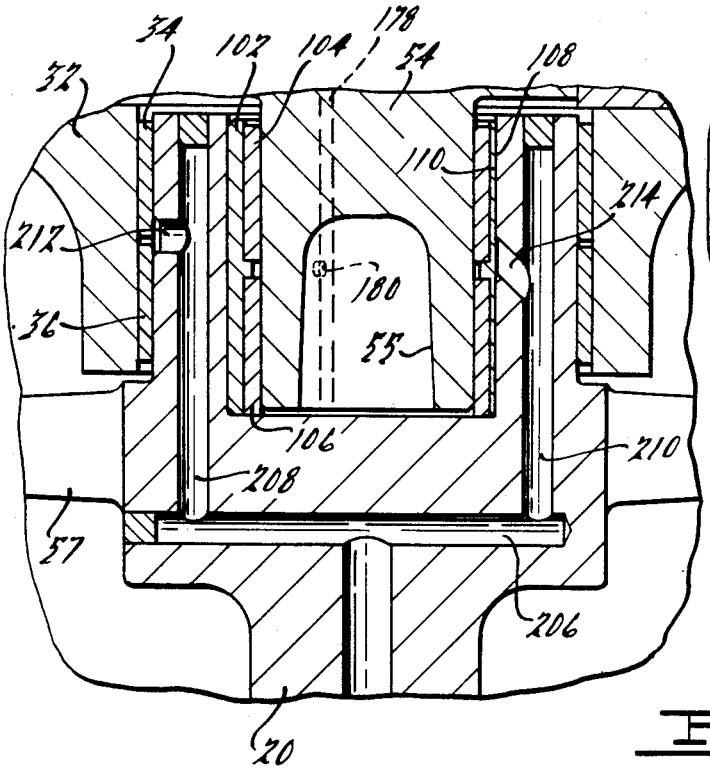
FIG. 7 is a partial sectional view taken along line 7—7 in FIG. 6.
Figure 9:
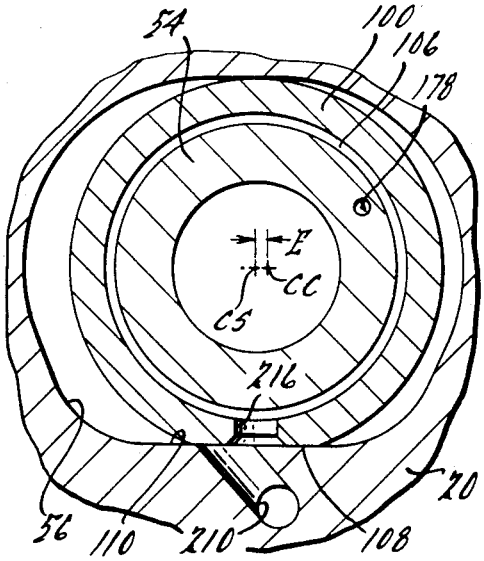
Figure 12:
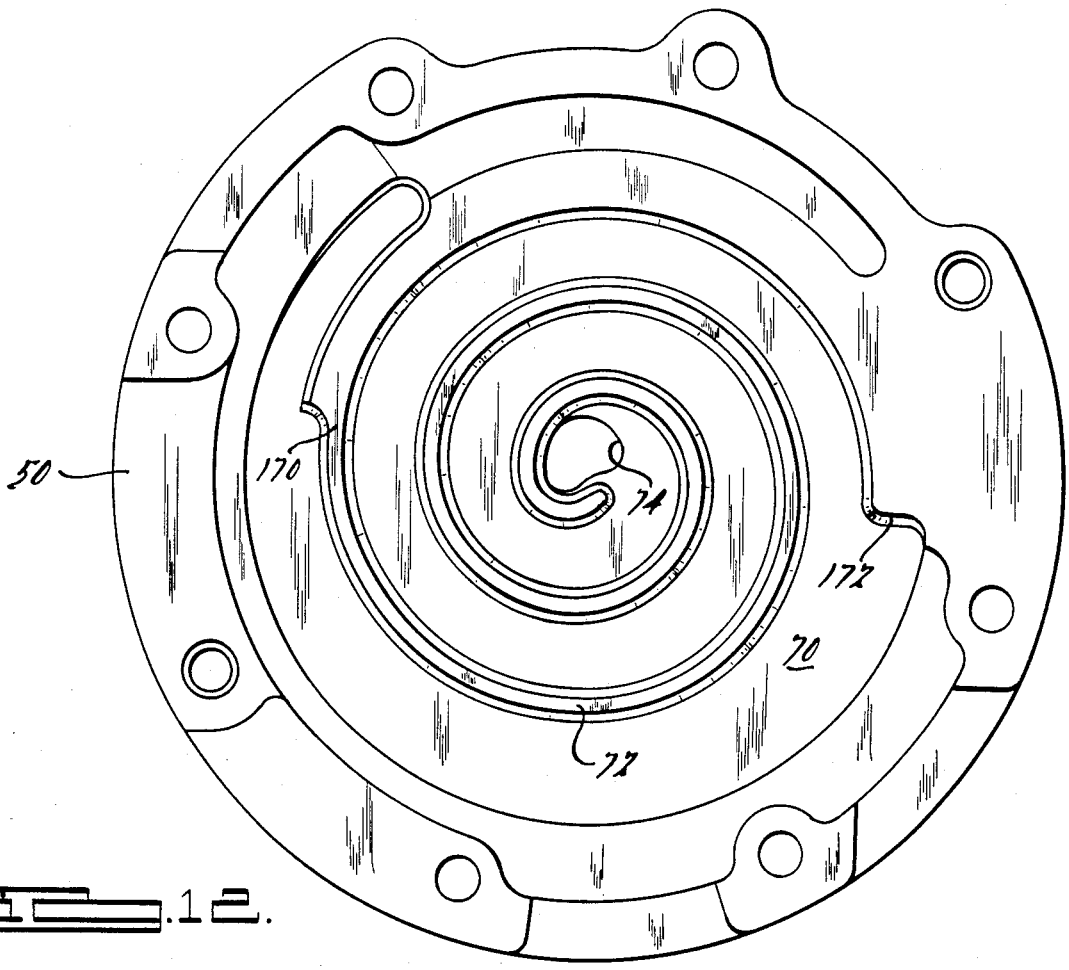
FIG. 12 is a bottom plan view of the fixed upper scroll member.

In the present compressor this tip wear is controlled by substantially increasing the thickness of the end of the outer wrap of each scroll member, as best shown in FIGS. 12 and 13. It is well known that the outer flank of the outer 180° of each scroll wrap is not utilized in the compression cycle. This fact is taken advantage of in the compressor of the present invention to control tip wear. As can be seen in FIG. 12, approximately the last 180° of wrap 72 is of much greater thickness than the rest of the wrap, starting at 170 and ending at 172. This surface slidingly rides on surface 90 of orbiting scroll member 52. Lubricating oil is supplied to the interface via a passage 174 in orbiting scroll member 52 which in turn receives oil from a vertical passage 178 communicating with the space between sleeve bearings 104 and 106 via a radial passage 180 (FIGS. 7 and 13). The outer end of passage 176 is plugged in the usual manner. As shown in FIG. 13, approximately the last 180° of wrap 92 is also of much greater thickness than the remainder of the wrap, starting at 182 and ending at 184. In addition, this widened wrap portion is provided with an oil supply groove 185 which receives oil from a passage 186 communicating with passage 176. The use of these relatively wide surfaces reduces unit loading in the axial direction and thereby reduces tip wear.

Lubrication

Lubrication of the respective parts of the machine is accomplished by using oil pump 24 which is mechanically driven by the crankshaft and operates to pump oil under pressure from the oil sump at the bottom of the shell, indicated generally at 200, to all of the moving parts of the machine which require lubrication. Oil pump 24 may be of any suitable type, in accordance with known criteria, however, for examplary purposes it is of the type shown in U.S. Pat. Nos. 4,331,420 or 4,331,421, the disclosures of which are incorporated herein by reference. The inlet to the pump is indicated at 202 and the outlet of the pump is via a vertically extending oil passage 204 extending up the center of crankshaft 20.

As best seen in FIGS. 1, 6 and 7, the upper end of passage 204 communicates with a transverse passage 206 in the crankshaft, the opposite ends of which communicate with vertically extending passages 208 and 210. The radially outer end of passage 206 and the upper ends of passages 208 and 210 are plugged in the usual manner. Passage 208 communicates with a radially extending passage 212 which places the space between sleeve bearings 34 and 36 in communication with a supply of lubricating oil under pressure. Passage 210 communicates with a generally radially extending passage 214 which communicates with the interface of surface 108 and 110 and a radially extending passage 216 in hub 100 for placing the space between sleeve bearing 104 and 106 in communication with a supply of lubricating oil under pressure. Lubricating oil is communicated from the space between the outer pair of sleeve bearings to the thrust bearing via passage 158, as aforesaid, and from the space between the inner pair of sleeve bearings to the mating scroll tip surfaces via passages 180, 178, 176, 174 and 186, as aforesaid.

Because the lower counterweight 59 is disposed below the liquid level of the oil sump (due to the size of the counterweight required to balance the rather large eccentric mass of the orbiting scroll), provision is made to prevent the rotating counterweight from pumping oil and thereby needlessly consume energy. This is accomplished by forming a recess 220 in lower bearing housing 28 which closely approximates the outside surface of counterweight 59 as it rotates. The outer periphery of chamber 220 communicates with an oil outlet conduit 222 which extends radially outwardly and then upwardly between the housing and shell. Upon starting of the compressor, the rotating of counterweight 59 will cause oil to be pumped out of chamber 220 via conduit 222 into the sump area of the shell. In order to permit this evacuation of oil from chamber 220, housing 28 is provided with a passage 224 which communicates at one end with the central portion of chamber 220 and at the other end with a conduit 226 which extends to above the level of oil in the bottom of the sump. This conduit permits gas or vapor to enter chamber 220 when the compressor is started, thereby permitting the evacuation of all oil therefrom. Excess oil at the top and bottom of the inner sleeve bearings, the top of the outer sleeve bearings and the inside of the thrust bearings is drained back to the crankcase via passageways 217 and 218.

Wrap Flank Contours

Conventional scroll compressors having wrap contours which are involutes of a circle require curvilinear translation between the fixed and moving scrolls in order for line-to-line flank contact to be mantained. If the curvilinear anti-rotation device is replaced with the linkage of the present invention, which allows slight pivoting of the orbiting scroll, some means of maintaining flank line-to-line contact must be employed to maximize efficiency. Two such techniques are disclosed. The first is an involute shifting technique, and the second is an involute modification which results in scroll flank profiles which are not true involutes or are not involutes of a circle. Flank leakage distances (i.e. the distance between the mating scroll wraps) are extremely small when the first technique is used. The second technique gives zero theoretical flank leakage distances.

Generally speaking, scroll compressors utilize two or more spiral wraps generated from the involute of a plane geometry and mounted on base plates. If a generating circle is used, its radius, the scroll wrap thickness and the total number of wraps are chosen to give the desired volumetric displacement and pressure ratio. When the scrolls are rotated 180° and brought together so that the flanks and tips touch, pockets are formed. If one scroll is made to move in curvilinear translation (no rotation of any line in the body) with respect to the other scroll, then these pockets are sealed and move inwardly toward the center or outwardly toward the scroll ends, depending on the direction of rotation. When there are more than 1½ working wraps, the fluid in the pockets will be compressed or expanded. If the motion is true curvilinear translation, perfect flank sealing will be obtained (discounting involute surface irregularities). Because of the relatively long sealing line of the flanks and tips, small clearances can result in substantially reduced efficiencies. Tip clearance management techniques are not specifically the subject matter of this invention; flank clearance management techniques are.

Figure 20A:
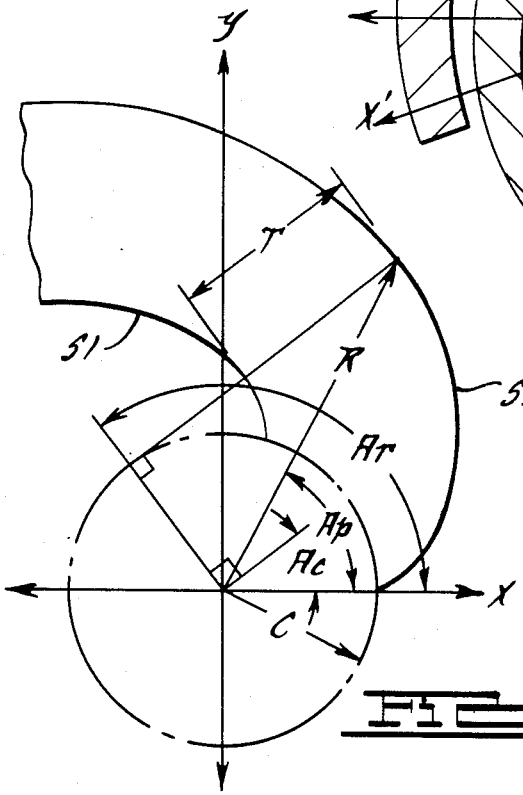
FIGS. 20A, 20B, 21, 22 and 23 are diagrams of the geometry of the present invention showing the nomenclature used.

By way of background, and with reference to FIG. 20A, the equations that describe the scroll involute profiles when the relative motion is curvilinear translation and the relative rotational displacement between the generating (x-y) axis of the scroll members is 180°, are:

$$R=C(1+(Ar-MT/C)^2)^{\frac{1}{2}}$$

$$Ar=Ac+Pi/2=Ap-\arctan(Ap)$$

Where:

- R is the distance from the center of the base circle to the point on the scroll profile
- C is the base generating circle radius
- Ar is the roll angle
- T is the thickness of the scroll wrap
- M is a logic modifier; M=1 for surface S1 and M=0 for surface S2
- Ac is the Numerical Control Angle that is incremented or it may be thought of as the angle of the crank when contact occurs between the moving and fixed scroll at the point under consideration.
- Ap is the polar coordinate angle Curvilinear translation motion requires the use of an anti-rotation device such as the complex and relatively expensive Oldham coupling. A much simpler and less costly device is the rotation controlling linkage arrangement described above. This arrangement, however, allows a slight pivoting of the orbiting scroll, which normally would cause the scroll flanks to separate or interfere and reduce machine efficiency. By changing the geometry of the wrap this clearance or interference can be reduced or eliminated. The present invention incorporates two novel profile modifications, as follows:

Shifting Technique

It has been discovered that conventional involutes of a circle can be used with the aforesaid linkage arrangement and excellent flank sealing characteristics obtained by merely forming the inside involute profile of a wrap flank on a different base circle center than the outside involute profile of the same wrap flank. The involute profiles are identical, but the resulting wrap varies in thickness throughout its length. The base circles of either or both inner and outer flanks on either or both scrolls may be shifted. Thus there are three possible cases:

(1) shifting the inner and outer profiles on only the fixed scroll;

(2) shifting the inner and outer profiles on only the orbiting scroll (3) shifting the inner and outer profiles on both scrolls.

Figure 19:
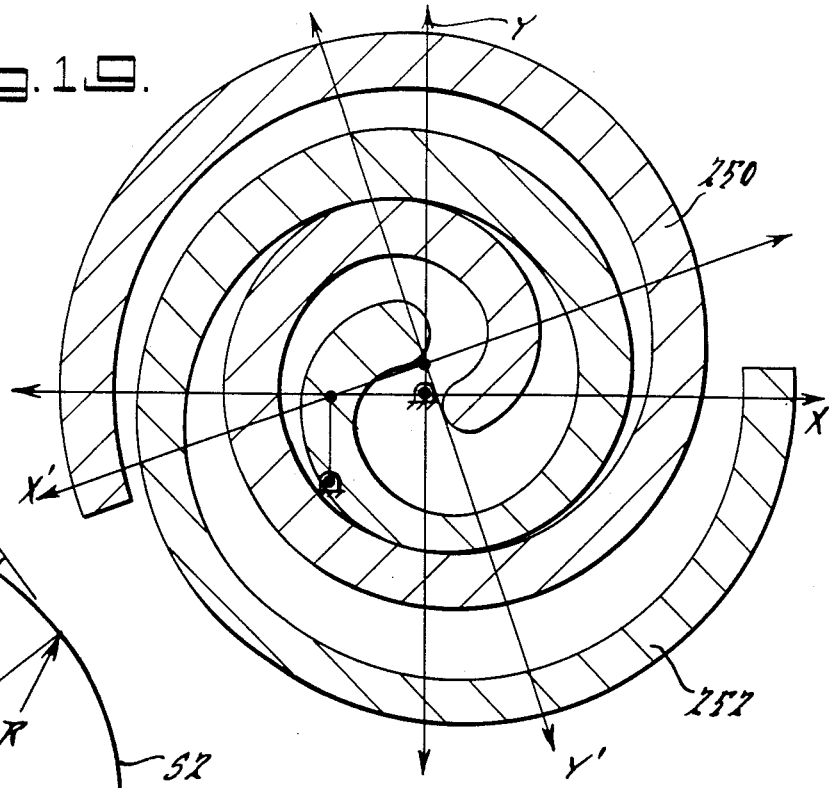
FIG. 19 is a diagrammatic illustration of one embodiment of a pair of mating scroll wraps embodying the principles of the present invention.

Case No. 1, surprisingly, has been discovered to provide the best sealing and Case No. 2 the least acceptable. This is based on theoretical analysis; it is believed that in actual practice the leakage which could occur between mating flanks even in Case No. 2 will probably be acceptable. A pair of such wraps 250 and 252 mated together are illustrated in an exaggerated form in FIG. 19. This is a Case No. 1 machine in which wrap 250 is the orbiting wrap and wrap 252 is the fixed wrap and has all of the correction.

Figure 21:
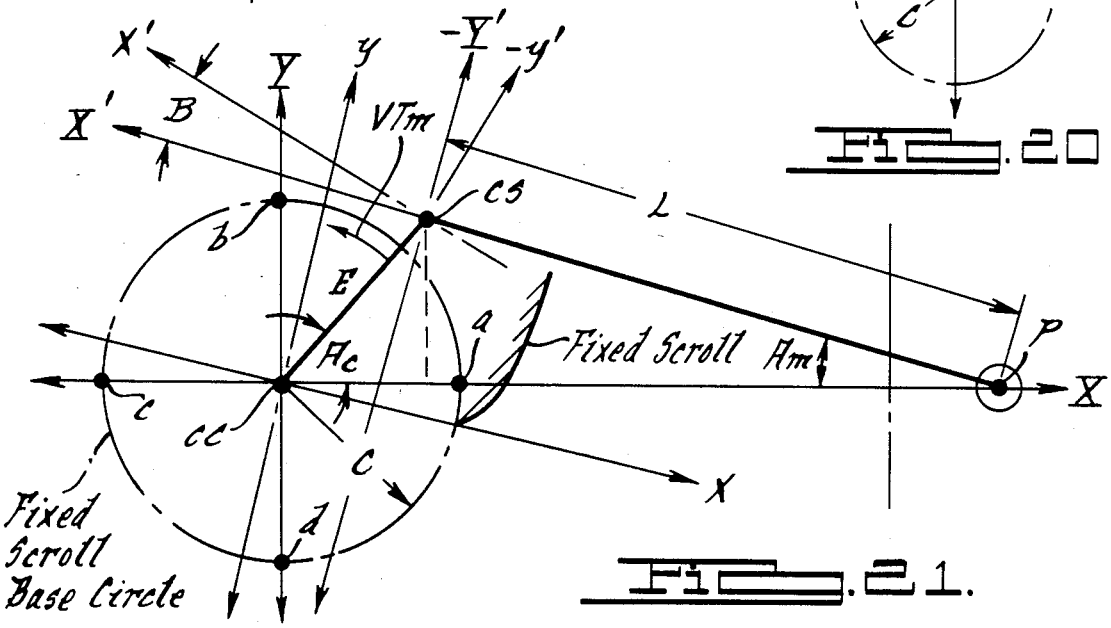

The geometry of the linkage mechanism of the present invention is illustrated in FIG. 21, where:

- P=location of rotation controlling pivot point on orbiting scroll (e.g. the axis of projection 124)
- cs=location of the geometric center of the orbiting scroll
- cc=rotational axis of crankshaft
- L=distance from the geometric center of the orbiting scroll to point P (i.e. the length of the imaginary link formed by the orbiting scroll).
- Am=Relative angle between scrolls
- B=angle from start of involute on orbiting base circle to the pivot pin center (polar)
- E=Eccentricity (radius of orbit of the orbiting scroll)
- V=Crankshaft angular velocity
- Tm=Time
- S1=Inner flank profile
- S2=Outer flank profile In order to design the scrolls of the present invention, one first must design conventionally shaped scrolls (such as would be used with an Oldham coupling) to provide the proper displacement, pressure ratio, and exit port geometry according to conventional procedures. This results in known values for the involute base circle radius C, the scroll thickness T and the number of wraps of outer surface. Once this is done, one needs to choose the location of point P, the pivot point of the orbiting scroll. The distance between the geometric center cs and point P is L. For purposes of manufacture, the distance L is chosen to be convenient. It could be less than the distance from the geometric scroll center to the outside of the scroll if pivot point P is on the underside of the scroll member, but preferably it will be outside of the outer wrap as shown in FIGS. 1, 4, and 13. Since the end of the outer wrap makes a convenient reference point, for purposes of demonstration pivot point P will be located there, although it could be at any location around the scroll periphery. It should be appreciated that length L represents the link formed by the orbiting scroll between the center cs and pivot point P. The line between cc and cs is referred to as the "line of centers".

As described above, it has been discovered that there are a number of basic linkage mechanisms which will accomplish the objective of permitting only a small amount of controlled rotation between scrolls. Because of ease of fabrication, low cost, and easy lubrication, the four-bar linkage is the preferred approach. If length L is sufficiently long and the link is substantially perpendicular to the line extending between P and cc in FIG. 21, the four-bar linkage motion becomes similar to the crank and slider embodiment of FIG. 16 since point P moves in essentially a straight line and length L does not change. This embodiment is therefore the easiest to analyze. The other mechanisms disclosed will follow a similar analysis with similar results.

The basic problem, looking at FIG. 21, is that the orbiting scroll will rotate through the angle Am as the eccentric moves the center of the orbiting scroll around the circle of the orbit with eccentricity E. These angular excursions result in a mismatch of scroll surfaces causing a simultaneous gap and interference condition to occur at the seal points between the scroll flanks, resulting in low capacity and efficiency. The amount of gap and interference depends upon the amount of mismatch between the scroll surfaces, which in turn depends upon the link geometry and the scroll configuration.

Assuming P moves radially on a straight line through the center of the generating circle of the fixed scroll, the value of Am is calculated as follows:

$$\sin(Am)=(E\sin(VTm)/L)$$

For small values of Am (which will be the case here) it will be assumed:

$$Am=\sin(Am)=(E\sin(VTm)\ \text{(radians)}$$

Therefore, because the maximum angle the orbiting scroll rotates with respect to the fixed scroll is at $VTm=90°$:

$$Am\ \max=E/L\ \text{(radians)}$$

Looking at FIG. 21, when the line of centers intersects position a, the value of Am is 0°. Thus, there is zero relative angle between the scrolls at that point, which means there is no scroll surface mismatch at that position. However, as the line of centers moves to point b, the value of Am increases to the value of Am max, resulting in the maximum amount of surface mismatch. If one requires that the sealing points with the present linkage arrangement be at the same points as with an Oldham coupling (i.e. with no relative rotation permitted), then the profiles must be modified to permit this. What has been observed is that at positions a and c, there is 0° relative angle between the scrolls and thus no radial correction required. At positions b and d, where the relative angle between the scrolls is maximum, the radial correction is maximum and equal to:

$$R\ \max=[(E/L)/2(Pi)]2(Pi)C=EC/L$$

In between the points of zero correction and maximum correction, the radial correction will have some intermediate correction approximately equal to:

$$(EC/L)\sin(VTm)$$

Thus, when the uncorrected scrolls are at the position requiring maximum correction, one set of seal points has a gap requiring a correction to close up, whereas the other set of seal points actually has interference. It has been discovered that these gaps and interferences can be corrected by appropriately shifting the involute profiles in a direction normal to a line through the scroll centers and pivot point P when the scrolls are in their unrotated position.

If the correction or shifting is to be applied to only one scroll wrap (Case Nos. 1 and 2) then the inner wrap profile is shifted in one direction along the normal line an amount equal to R max in order to close the gap and eliminate interference, and the outer wrap profile is shifted the same amount in the opposite direction for the same reason.

When all four flank profiles are corrected, (Case No. 3), then a similar correction is made to both scroll wraps. Specifically, the inner profile of one scroll wrap is shifted in one direction along the normal line to close up the gap and eliminate interference, and the outer profile of the same wrap is shifted in the other direction for the same reason. The inner profile of the second scroll wrap is also shifted, but in the opposite direction as the inner profile on the first scroll wrap, and the outer profile is shifted in the opposite direction as the outer profile on the first scroll wrap. The amount of correction to be applied to each of the wrap flanks under Case No. 3 is as follows:

| Fixed Scroll Wrap | | Orbiting Scroll Wrap | |
|---|---|---|---|
| Outer Flank | Inner Flank | Outer Flank | Inner Flank |
| (X)(Rmax) | (Y)(Rmax) | (1 − Y)(Rmax) | (1 − X)(Rmax) |

where X is the proportion (%/100) of correction desired on the outer flank of the fixed scroll wrap an Y is the proportion of correction desired on the inner flank of the fixed scroll wrap. Thus, the correction to the outer flank of the fixed scroll plus the correction to the inner flank of the orbiting scroll will total R max, as will the combined correction to the inner flank of the fixed scroll and the outer flank of the orbiting scroll.

The result is one or a pair of scrolls having a wrap which is no longer of uniform thickness. Observe in FIG. 19 that fixed scroll wrap 252, to which all correction has been applied, is the same thickness wherever it intersects the x axis, is of reduced thickness wherever it intersects the y axis below the x axis, and is of increased thickness wherever it intersects the y axis above the x axis. Thus, as on continues inwardly along a corrected scroll, the thickness changes continually, having a maximum, minimum, or "nominal" value approximately every 90°. The result is that the profiles have a shape and position during operation such that they come extremely close to sealing at all the required points at the required times.

As noted, the involute shifting method does produce a small flank clearance or interference. The magnitude of this clearance or interference depends not only on crank angle and basic scroll geometry, but also on the ratio K, which is the ratio of modification added to the fixed scroll divided by the total modification. Therefore, assuming both scrolls are modified the same, if the total modification is added to the fixed scroll, K=1; whereas, if the total modification is added to the moving scroll, K=0. Satisfactorily operating compressors have been made and tested having K=0.5, which was originally believed to be optimum. Subsequent analysis, however, surprisingly revealed that the smallest error is encountered when K=1, whereas the largest error occurs when K=0. There is a nearly linear relationship between the two so the best value for K is 1. K may also have values greater than unity or smaller than zero, but these values have no known advantages.

Furthermore, as noted above, the same amount of correction need not be applied to each scroll. In the case of unequal correction there will be different values of K for different flank interfaces in the same machine. As used herein the ratio K1 represents the K ratio for the fixed outer and orbiting inner flanks, and K2 the K ratio for the fixed inner and orbiting outer flanks. Thus, the optimum situation (all correction on the fixed scroll) will occur when K1=1 and K2=1, which is the same as having K=1.

Overall, the potential theoretical errors in the shifting method come from three different causes:

(1) The sine error; due to the approximation A=sin (A).

(2) The link arc error. When the link length is sufficiently long this error becomes very small; practical packaging, however, usually restricts the length. This error can be completely eliminated by using a crank and slider.

(3) The choice of the surface to correct. By placing the shift entirely on the fixed scroll, this error is zero. By placing the shift entirely on the moving scroll, this error has its maximum value. Since there is known advantage to placing it on the moving scroll, it should be placed on the fixed scroll.

It is believed, however, that in practice all these errors are sufficiently negligible that they will not adversely effect compressor performance.

Involute Modification Technique

Figure 22:
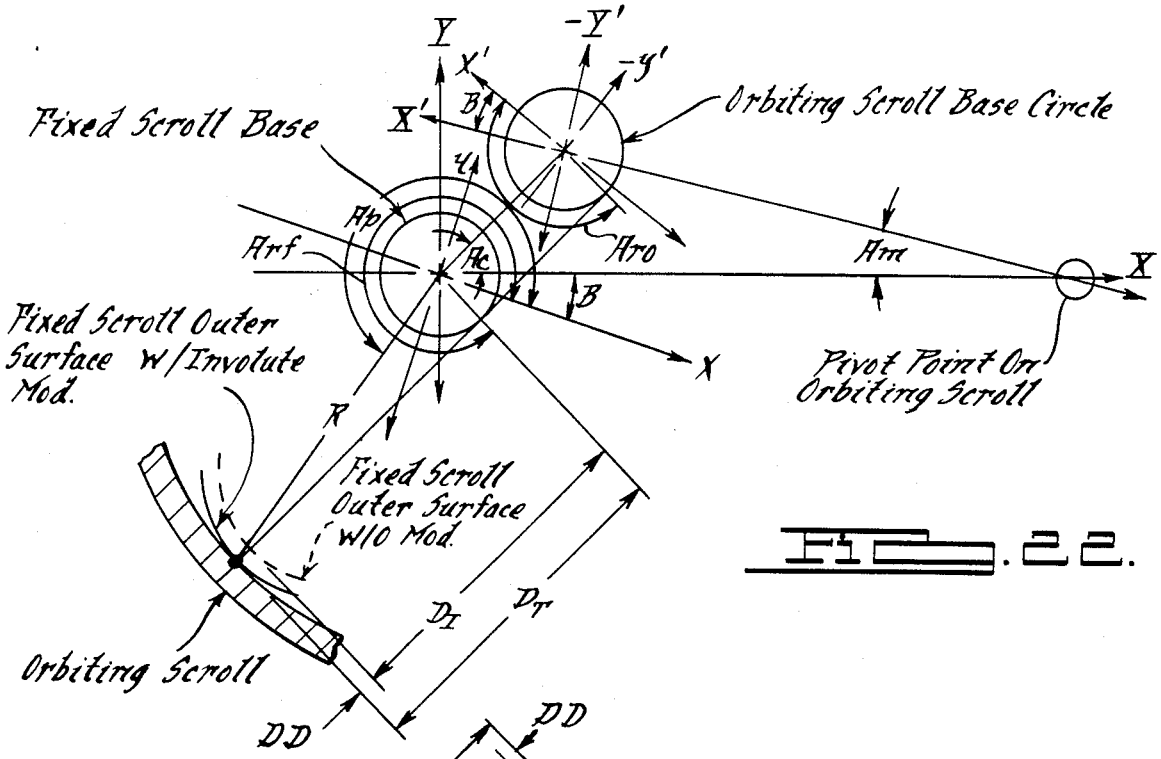
Figure 23:
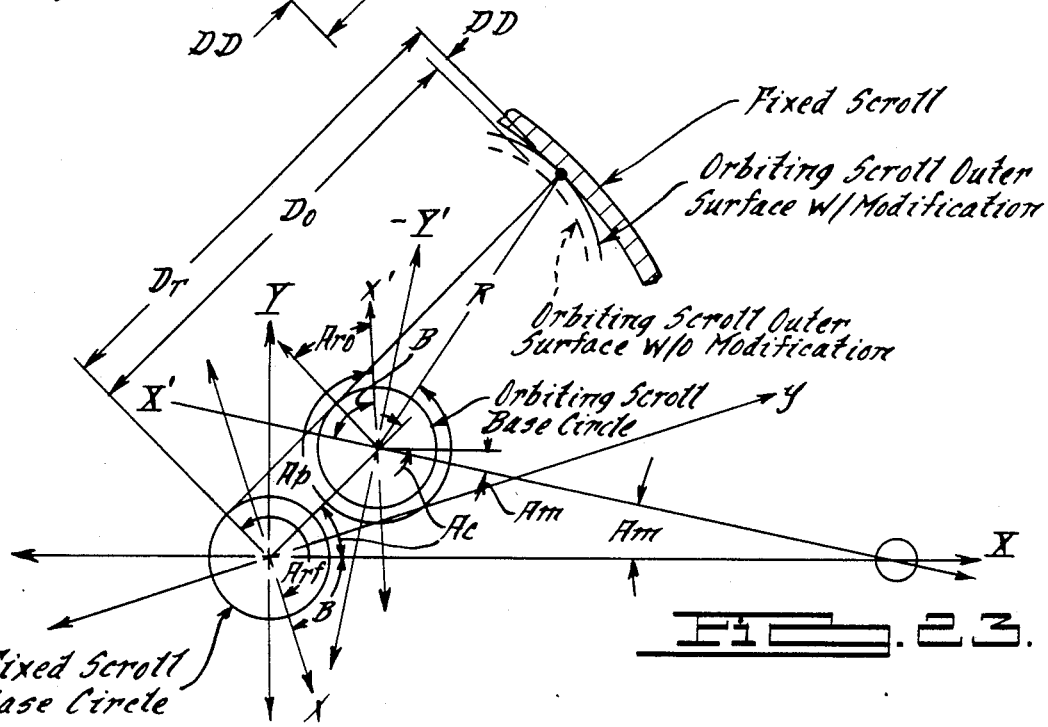

FIG. 22 shows a flank contact between the outer fixed and inner orbiting flanks, and FIG. 23 shows a flank contact between the outer orbiting and inner fixed flanks. These points are defined for any given geometric parameters (C,T,L) and compressor crank position (Ac). The additional material that must be added to or subtracted from the involute profile for continuous contact between scrolls has been determined to be in accordance with the following:

| | |
|---|---|
| $R = C(1 + Doc^2)^{\frac{1}{2}}$ | |
| Doc = Ar + K1(Am) | Fixed Outer Scroll Surface |
| Doc = Ar + (K2 − 1)Am | Moving Outer Scroll Surface |

-continued

| | |
|---|---|
| Doc = Ar + K2(Am) − T/C | Fixed Inner Scroll Surface |
| Doc = Ar + (K1 − 1)Am − T/C | Moving Inner Scroll Surface |
| Ar = Ac + B + 5(Pi)/2 | Fixed Outer Scroll Surface |
| Ar = Ac + B + 5(Pi)/2 + Am | Moving Outer Scroll Surface |
| Ar = Ac + B + 3(Pi)/2 | Fixed Inner Scroll Surface |
| Ar = Ac + B + 3(Pi)/2 + Am | Moving Inner Scroll Surface |

$$Ap = Ar - \arctan(Doc)$$

For restraining link (4-bar):

$$Am = B - Bb$$

Bb=[see calculations in steps 3-5 of the Algorithm set forth below]

For restraining slider (crank and slider with pin on scroll):

$$Am = \arcsin([E/L]\sin(Ac))$$

K1=Modification amount added to fixed scroll outer flank divided by total modification between fixed outer and moving inner flanks.

K2=Modification amount added to fixed scroll inner flank divided by total modification between fixed inner and moving outer flanks.

Doc=Dummy variable

Ac="crank angle", although it is better thought of as a mapping increment angle.

B=angle from start of involute or orbiting base circle to the pivot pin center (polar).

C=radius of base generating circle

T=thickness of scroll wrap

Increment Ac beginning with Ac such that Ar=0.

$$Nw = \text{number of wraps} = (Ar \text{ to end of scroll} - Pi/2)/2(Pi)$$

$$\text{Stop when } Ac = 2(Pi)(Nw) + Pi/2$$

in cartesian coordinates:

$$X = C(1 + Doc^2)^{\frac{1}{2}} \cos(Ar - \arctan(Doc))$$

$$Y = C(1 + Doc^2)^{\frac{1}{2}} \sin(Ar - \arctan(Doc))$$

In numerically controlled milling machines, the cartesian equations must be programmed to give position coordinates. One possible Algorithm is as follows:

1.

If involute profile=inner surface then $$Ac = -B - 3(Pi)/2 + Au$$

If involute profile=outer surface then $$Ac = -B - 5(Pi)/2 + Au$$

2.

If restraining slider (crank and slider with pin on scroll) is used then:

$$Am = \arcsin[(E/L)\sin(Ac)]$$

Go to step 7

3.

If restraining link (4-bar linkage) is used then $$Xa = (E)\cos(Ac + B + Pi)$$

$Ya=(E)\sin(Ac+B+Pi)$ $Xgb=Xa+(L)\cos(B+Pi)$

Xc=x coordinate of the center of projection 124 (FIG. 4)

Yc=y coordinate of the center of projection 124 (FIG. 4)

$Az=((Xc-Xa)^2+(Yc-Ya)^2)^{0.5}$ $Yu=(Xa-Xc)/Az$ $Cc=\arctan(Yu)$ $Fl1=Fl2=1$

If (Ya−Yc)>0 then go to step 4

$Cc=2(pi)-Cc$ $Fl1=-1$

4.

$Xum=Xc+Lik(\cos(Cc))$

If Xgb−Xum<0 then go to step 5

$Fl2=-1$

5.

$Yu=(Az^2+Lik^2-L^2)/2(Az)(Lik)$ $Cb=(Fl1)(Fl2)\arctan(Yu)$ $Xb=Xc+Lik(\cos(Cc+Cb))$ $Yb=Yc+Lik(\sin(Cc+Cb))$ $Xgb=Xb$ $Bb=\arctan((Xa-Xb)/L)$ If Ya−Yb22 0 then go to step 6

$Bb=2(pi)-bb$

6.

$Am=B-Bb$

7.

$Ar=Ac+B+5(Pi)/2-Pi(L1)+Am(L2)$ $Doc=Ar+K(Am)(L3)+(K-1-)(Am)(L2)-(T/C)(L1)$ $R=C(1+Doc^2)^{\frac{1}{2}}$ $p=Ar-\arctan(Doc)$ $X=((R)\cos(p)+[(T1)\sin(Ar)]TT)L4$ $Y=(R)\sin(p)-[(T1)\cos(Ar)]TT$

8.

$Ac=Ac+Ai$

9.

$Ar=2(pi)(Nw)+Pi/2$ then go to step 2

10.

The procedure is complete

NOMENCLATURE

E=Eccentricity=C(Pi)−T

C=Generating circle radius

L=Distance between geometric center of orbiting scroll and link pin center P

Ac=Mapping angle

K1=Modification amount added to fixed scroll outer flank divided by total modification between fixed outer and moving inner flanks K2=Modification amount added to fixed scroll inner flank divided by total modification between fixed inner and moving outer flanks R=Polar vector magnitude Ar=Roll angle Aro=Roll angle (Ar) on moving (orbiting) scroll Arf=Roll angle (Ar) on fixed scroll B=Angle from start of involute on orbiting base circle to the pivot pin center (polar).

T=Scroll wrap thickness

Ai=Increment angle (i.e., the angle by which AC is incremented)

Figure 20B:
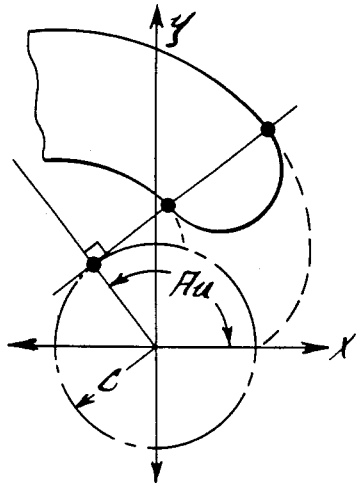

Au=Truncation angle in FIG. 20B (the angle from the x axis to a line perpendicular to a line tangent to the base generating circle and passing through the points of tangency of the physical inner end of a wrap and the involute curves from which its flanks were generated)

T1=Tool radius

D=Distance between base circle center and anchor pin center

Lik=Length of rotation controlling link (4-bar)

| | LOGIC COEFFICIENTS: | | | | |
|---|---|---|---|---|---|
| Surface: | L1 | L2 | L3 | L4 | TT |
| Fixed inner | 1 | 0 | 1 | −1 | −1 |
| Fixed outer | 0 | 0 | 1 | −1 | 1 |
| Moving inner | 1 | 1 | 0 | 1 | −1 |
| Moving outer | 0 | 1 | 0 | 1 | 1 |

Method of Manufacture

Figure 24:
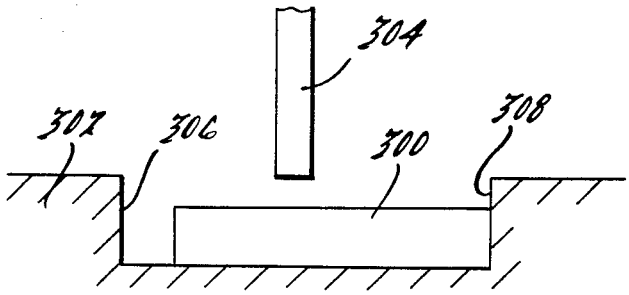
FIG. 24 is a schematic view of an apparatus which can be used to practice the machining method of the present invention.

The present invention includes a very simple and unique method of manufacturing the fixed and orbiting scrolls on a N.C. or similar machine utilizing the aforesaid shifting technique. This method is schematically illustrated in FIG. 24, where 300 is a workpiece to be formed into a scroll wrap, 302 is a fixture supporting workpiece 300 while it is being machined by a cutter 304, which could be an end mill. The machine which positions cutter 304 with respect to workpiece 300 is programmed in the conventional manner to form the inner and outer flank profiles (identical curves) from the common base generating circle of the involute scroll. Thus, if the workpiece is fixed in one position on the fixture for the entire flank machining operation, a conventional scroll wrap of uniform thickness will be generated, with both flanks being involutes of the same base circle.

In the practice of the present invention, however, the outer flank of the wrap is machined when the workpiece is in the position shown in which it is disposed against stop 308, and the inner flank of the wrap is machined when the workpiece is disposed against stop 306, no other changes being made to the orientation of the workpiece. The distance between stops 306 and 308 is equal to the total amount of shifting of the involute base generating circle which is desired, calculated in accordance with the criteria set forth with respect to the aforesaid shifting method, plus the overall dimension of the workpiece between the stops; i.e. the distance the workpiece moves from stop 308 to 306 is equal to the desired displacement of the base generating circles. The distribution of the amount of correction applied to each flank is in turn determined by the base position (reference point) of cutting tool 304 with respect to stops 306 and 308. If the base position is centered, then an equal amount of correction will be applied to each flank.

While it will be apparent that the preferred embodiments of the invention disclosed are well calculated to provide the advantages and features above stated, it will be appreciated that the invention is susceptible to modification, variation and change without departing from the proper scope or fair meaning of the subjoined claims. As used herein all references to the "present invention" or "this invention" (and like expressions) are intended to encompass all of the different inventions which reside in the compressor embodiments disclosed herein. Certain of these inventions are claimed in this application and others are claimed in assignee's copending application entitled Scroll-Type Machine which has the same disclosure as this application and is filed of even date. This application specifically covers the "shifting technique" when correction is applied to less than all four flanks, as well as the "involute modification technique", both of which are improvements based on the inventions claimed in the aforesaid copending application.

We claim:

1. A scroll-type machine comprising:

a first scroll member having a first spiral wrap of generally involute shape;

a second scroll member of generally involute shape having a second spiral wrap and being mounted for movement with respect to said first scroll member, said second wrap being intermeshed with said first wrap so that when said second wrap is moved with respect to said first wrap along a predetermined path at least two fluid pockets of progressively changing volume are formed; and means for causing said second wrap to move along said predetermined path, including:

drive means for causing a portion of said second scroll member to move in an orbital path with respect to said first scroll member, and rotation controlling means for restricting rotational movement of said second scroll member, said rotation controlling means comprising a link having one portion pivotally connected to said second scroll member and another portion mounted for rotation about an axis which is fixed with respect to said first scroll member, the effective length of said link being greater than the radius of said orbital path.

2. A scroll-type machine as claimed in claim 1, wherein the axis of said link extending between said link portions is generally perpendicular to a radius of said second wrap passing through said pivotal connection of said link to said second scroll member.

3. A scroll-type machine as claimed in claim 1, wherein pivotal connection of said link to said second scroll member is disposed radially outwardly of said second wrap.

4. A scroll-type machine as claimed in claim 1, wherein said other portion of said link is mounted to said first scroll member.

5. A scroll-type machine as claimed in claim 1, wherein said machine is disposed within a hermetic shell, and said other portion of said link is mounted to said shell.

6. A scroll-type machine comprising:

a fixed scroll member having a fixed spiral wrap;

the profiles of the inner and outer flanks of said fixed wrap each being the involute of a plane geometric shape;

a movable scroll member having a movable spiral wrap and being mounted for movement with respect to said fixed scroll member, the profiles of the inner and outer flanks of said movable wrap each being the involute of a plane geometric shape;

said movable wrap being intermeshed with said fixed wrap so that when said movable wrap is moved with respect to said fixed wrap along a predetermined path fluid pockets of progressively changing volume are formed; and means for causing said movable wrap to move along said predetermined path, including rotation controlling means for restricting rotational movement of said movable scroll member with respect to said fixed scroll member by limiting it to a predetermined amount, the centers of the generating shapes of the profiles of the flanks of said fixed wrap being displaced from one another a sufficient distance to accommodate said predetermined amount of rotation and maintain sealing contact between said intermeshed wraps in all operative relative positions thereof.

7. A scroll-type machine as claimed in claim 1, wherein both said geometric shapes are generating circles.

8. A scroll-type machine as claimed in claim 1, wherein the centers of the generating shapes of the profiles of both flanks of said movable wrap are coincident with one another.

9. A scroll-type machine as claimed in claim 8, wherein both said geometric shapes are generating circles.

10. A scroll-type machine as claimed in claim 9, wherein said rotation controlling means is connected to said movable scroll member at substantially a single point.

11. A scroll-type machine as claimed in claim 10, wherein said centers of the generating circles of said fixed wrap are displaced from one another substantially along a line normal to a line extending between said single point and the center of said movable wrap when said scroll members are not rotated relative to one another.

12. A scroll-type machine as claimed in claim 11, wherein the center of said movable wrap moves in a generally circular orbit and said centers of the generating circles of said fixed wrap are of equal radius and displaced from one another by an amount equal to EC/L, where:

E=the radius or orbit of said movable wrap;

C=the radius of said generating circles of of said fixed wrap

L=the distance from the center of said movable wrap to said single point.

13. A scroll-type machine as claimed in claim 1, wherein said rotation controlling means is connected to said movable scroll member at substantially a single point and said centers of the generating shapes of said fixed wrap are displaced from one another substantially along a line normal to a line extending betwen said single point and the center of said movable wrap when said scroll members are not rotated relative to one another.

14. A fixed scroll member and a movable scroll member for a scroll-type machine, a portion of said movable scroll member adapted to orbit with respect to said fixed scroll member with an eccentricity E, said movable scroll member having rotation controlling means affixed thereto at a point P, each of said scroll members including a scroll wrap having inner and outer surfaces based on a generating circle and defined by the following equations (cartesian coordinates):

$$X=C(1+Doc^2)^{\frac{1}{2}}\cos(Ar-\arctan(Doc))$$

$$Y=C(1+Doc^2)^{\frac{1}{2}}\sin(Ar-\arctan(Doc))$$

where:

| | |
|---|---|
| $R = C(1 + Doc^2)^{\frac{1}{2}}$ | |
| Doc = Ar + K1(Am) | Fixed Outer Scroll Surface |
| Doc = Ar + (K2 − 1)Am | Moving Outer Scroll Surface |
| Doc = Ar + K2(Am) − T/C | Fixed Inner Scroll Surface |
| Doc = Ar + (K1 − 1)Am − T/C | Moving Inner Scroll Surface |
| Ar = Ac + B + 5(Pi)/2 | Fixed Outer Scroll Surface |
| Ar = Ac + B + 5(Pi)/2 + Am | Moving Outer Scroll Surface |
| Ar = Ac + B + 3(Pi)/2 | Fixed Inner Scroll Surface |
| Ar = Ac + B + 3(Pi)/2 + Am | Moving Inner Scroll Surface |

$$Ap=Ar-\arctan(Doc)$$

$$Am=\arcsin([E/L]\sin(Ac))$$

$$Am=\arcsin([E/L]\sin(Ac))$$

K1=Modification amount added to fixed scroll outer flank divided by total modification between fixed outer and moving inner flanks K2=Modification amount added to fixed scroll inner flank divided by total modification between fixed inner and moving outer flanks

*Doc*=Dummy variable

*Ac*=Mapping increment angle

*B*=angle from start of involute on orbiting base circle to the pivot pin center (polar)

*C*=radius of base generating circle

*T*=thicknes of scroll wrap $E=C(Pi)-T$

*L*=Distance between geometric center of orbiting scroll and link pin center P

Ac being incremented beginning with Ac such that Ar=0

Nw=number of wraps=(Ar to end of scroll−Pi/2)/2(*Pi*)

Stopping when $Ac=2(Pi)(Nw)+Pi/2$.

15. A fixed scroll member and a movable scroll member as claimed in claim 14, further comprising a crank and slider linkage operatively connected between said fixed scroll member and said movable scroll member to restrict relative rotation of said scroll members to a limited predetermined amount.

16. A fixed scroll member and a movable scroll member for a scroll-type machine, a portion of said movable scroll member adapted to orbit with respect to said fixed scroll member with an eccentricity E, said movable scroll member having rotation controlling means affixed thereto at a point P, each of said scroll members including a scroll wrap having inner and outer surfaces based on a generating circle and defined by the following equations (cartesian coordinates):

$$X=C(1+Doc^2)^{\frac{1}{2}}\cos(Ar-\arctan(Doc))$$

$$Y=C(1+Doc^2)^{\frac{1}{2}}\sin(Ar-\arctan(Doc))$$

where:

| | |
|---|---|
| $R = C(1 + Doc^2)^{\frac{1}{2}}$ | |
| Doc = Ar + K1(Am) | Fixed Outer Scroll Surface |
| Doc = Ar + (K2 − 1)Am | Moving Outer Scroll Surface |
| Doc = Ar + K2(Am) − T/C | Fixed Inner Scroll Surface |
| Doc = Ar + (K1 − 1)Am − T/C | Moving Inner Scroll Surface |
| Ar = Ac + B + 5(Pi)/2 | Fixed Outer Scroll Surface |
| Ar = Ac + B + 5(Pi)/2 + Am | Moving Outer Scroll Surface |
| Ar = Ac + B + 3(Pi)/2 | Fixed Inner Scroll Surface |
| Ar = Ac + B + 3(Pi)/2 + Am | Moving Inner Scroll Surface |

$$Ap=Ar-\arctan(Doc)$$

to calculate Am:

(1)

$$Xa=(E)\cos(Ac+B+Pi)$$

$$Ya=(E)\sin(Ac+B+Pi)$$

$$Xgb=Xa+(L)\cos(B+Pi)$$

$Xc=x$ coordinate of point $P$ $Yc=y$ coordinate of point $P$ $$Az=((Xc-Xa)^2+(Yc-Ya)^2)^{0.5}$$

$$Yu=(Xa-Xc)/Az$$

$$Cc=\arctan(Yu)$$

$$Fl1=Fl2=1$$

If $(Ya-Yc)>0$ then goto step 2

$$Cc=2(pi)-Cc$$

$$Fl1=-1$$

(2)

$$Xum=Xc+Lik(\cos(Cc))$$

If $Xgb-Xum<0$ then goto step 3

$$Fl2=-1$$

(3)

$$Yu=(Az^2+Lik^2-L^2)/2(Az)(Lik)$$

$$Cb=(Fl1)(Fl2)\arctan(Yu)$$

$$Xb=Xc+Lik(\cos(Cc+Cb))$$

$$Yb=Yc+Lik(\sin(Cc+Cb))$$

$Xgb=Xb$ $Bb=\arctan((Xa-Xb)/L)$

If $Ya-Yb>0$ then goto step 4

$Bb=2(pi)-Bb$ (4)

$Am=B-Bb$

K1=Modification amount added to fixed scroll outer flank divided by total modification between fixed outer and moving inner flanks K2=Modification amount added to fixed scroll inner flank divided by total modification between fixed inner and moving outer flanks Doc=Dummy variable Ac=Mapping increment angle B=angle from start of involute on orbiting base circle to the pivot pin center (polar)

C=radius of base generating circle

T=thicknes of scroll wrap $E=C(Pi)-T$

L=Distance between geometric center of orbiting scroll and link pin center P

Ac being incremented beginning with Ac such that $Ar=0$

Nw=number of wraps=($Ar$ to end of scroll$-Pi/2)/2(Pi)$

Stopping when $Ac=2(Pi)(Nw)+Pi/2$.

17. A fixed scroll member and a movable scroll member as claimed in claim 16, further comprising a four-bar linkage operatively connected between said said fixed scroll member and said movable scroll member to restrict relative rotation of said scroll members to a limited predetermined amount.

18. A fixed scroll member and a movable scroll member for a scroll-type machine, a portion of said movable scroll member adapted to orbit with respect to said fixed scroll member with an eccentricity E, said movable scroll member having rotation controlling link affixed thereto at a point P, each of said scroll members including a scroll wrap having inner and outer surfaces based on a generating circle and being of a contour formed by an NC-type machine operating in accordance with the following routine:

1.

If involute profile=inner surface then $Ac=-B-3(Pi)/2+Au$

If involute profile=outer surface then $Ac=-B-5(Pi)/2+Au$

2.

$Xa=(E)\cos(Ac+B+Pi)$ $Ya=(E)\sin(Ac+B+Pi)$ $Xgb=Xa+(L)\cos(B+Pi)$ $Xc=x$ coordinate of point $P$ $Yc=y$ coordinate of point $P$ $Az=((Xc-Xa)^2+(Yc-Ya)^2)^{0.5}$ $Yu=(Xa-Xc)/Az$ $Cc=\arctan(Yu)$ $Fl1=Fl2=1$ If $(Ya-Yc)>0$ then goto step 3

$Cc=2(pi)-Cc$ $Fl1=-1$

3.

$Xum=Xc+Lik(\cos(Cc))$

If Xgb−Xum<0 then goto step 4

$Fl2=-1$

4.

$Yu=(Az^2+Lik^2-L^2)/2(Az)(Lik)$ $Cb=(Fl1)(Fl2)\arctan(Yu)$ $Xb=Xc+Lik(\cos(Cc+Cb))$ $Yb=Yc+Lik(\sin(Cc+Cb))$ $Xgb=Xb$ $Bb=\arctan((Xa-Xb)/L)$ If Ya−Yb>0 then goto step 5

$Bb=2(pi)-Bb$

5.

$Am=B-Bb$

6.

$Ar=Ac+B+5(Pi)/2-Pi(L1)+Am(L2)$ $Doc=Ar+K(Am)(L3)+(K-1)(Am)(L2)-(T/C)(L1)$ $R=C(1+Doc^2)^{\frac{1}{2}}$ $p=Ar-\arctan(Doc)$ $X=((R)\cos(p)+[(T1)\sin(Ar)]TT)L4$ $Y=(R)\sin(p)-[(T1)\cos(Ar)]TT$

7.

$Ac=Ac+Ai$

8.

If $Ar=2(pi)(Nw)+Pi/2$ then goto step 2

9.

The procedure is complete where:

$E=\text{Eccentricity}=C(Pi)-T$

C=Generating circle radius

L=Distance between geometric center of orbiting scroll and link pin center P
Ac=Mapping angle
K1=Modification amount added to fixed scroll outer flank divided by total modification between fixed outer and moving inner flanks
K2=Modification amount added to fixed scroll inner flank divided by total modification between fixed inner and moving outer flanks
R=Polar vector magnitude
Ar=Roll angle
Aro=Roll angle (Ar) on moving (orbiting) scroll
Arf=Roll angle (Ar) on fixed scroll
B=Angle from start of involute on orbiting base circle to the pivot pin center (polar)
T=Scroll wrap thickness
Ai=Increment angle (i.e., the angle by which AC is incremented)
Au=Truncation angle (the angle from the x axis to a line perpendicular to a line tangent to the base generating circle and passing through the points of tangency of the physical inner end of a wrap and the involute curves from which its flanks were generated)
T1=Tool radius
D=Distance between base circle center and anchor pin center
Lik=Length of rotation controlling link
where logic coefficients are:

| Surface: | L1 | L2 | L3 | L4 | TT |
|---|---|---|---|---|---|
| Fixed inner | 1 | 0 | 1 | −1 | −1 |
| Fixed outer | 0 | 0 | 1 | −1 | 1 |
| Moving inner | 1 | 1 | 0 | 1 | −1 |
| Moving outer | 0 | 1 | 0 | 1 | 1 |

19. A fixed scroll member and a movable scroll member as claimed in claim 18, further comprising a four-bar linkage operatively connected between said said fixed scroll member and said movable scroll member to restrict relative rotation of said scroll members to a limited predetermined amount.

20. A fixed scroll member and a movable scroll member for a scroll-type machine a portion of said movable scroll member adapted to orbit with respect to said fixed scroll member with an eccentricity E, said movable scroll member having rotation controlling link affixed thereto at a point P, each of said scroll members including a scroll wrap having inner and outer surfaces based on a generating circle and being of a contour formed by an NC-type machine operating in accordance with the following routine:

1.

If involute profile=inner surface then $$AC=-B-3(Pi)/2+Au$$

If involute profile=outer surface then $$AC=-B-5(Pi)/2+Au$$

2.

$$Am=\arcsin\,[(E/L)\sin(Ac)]$$

3.

$$Ar=Ac+B+5(Pi)/2-Pi(L1)+Am(L2)$$

$$Doc=Ar+K(Am)(L3)+(K-1)(Am)(L2)-(T/C)(L1)$$

$$R=C(1+Doc^2)^{\frac{1}{2}}$$

$$p=Ar-\arctan(Doc)$$

$$X=((R)\cos(p)+[(T1)\sin(Ar)]TT)L4$$

$$Y=(R)\sin(p)-[(T1)\cos(Ar)]TT$$

4.

$$Ac=Ac+Ai$$

5.

If $Ar=2(pi)(Nw)+Pi/2$ then go to step 2

6.

The procedure is complete where:

$$E=\text{Eccentricity}=C(Pi)-T$$

C=Generating circle radius
L=Distance between geometric center of orbiting scroll and link pin center P
Ac=Mapping angle
K1=Modification amount added to fixed scroll outer flank divided by total modification between fixed outer and moving inner flanks
K2=Modification amount added to fixed scroll inner flank divided by total modification between fixed inner and moving outer flanks
R=Polar vector magnitude
Ar=Roll angle
Aro=Roll angle (Ar) on moving (orbiting) scroll
Arf=Roll angle (Ar) on fixed scroll
B=Angle from start of involute on orbiting base circle to the pivot pin center (polar)
T=Scroll wrap thickness
Ai=Increment angle (i.e., the angle by which AC is incremented)
Au=Truncation angle the angle from the x axis to a line perpendicular to a line tangent to the base generating circle and passing through the points of tangency of the physical inner end of a wrap and the involute curves from which its flanks were generated)
T1=Tool radius
D=Distance between base circle center and anchor pin center
where logic coefficients are:

| Surface: | L1 | L2 | L3 | L4 | TT |
|---|---|---|---|---|---|
| Fixed inner | 1 | 0 | 1 | −1 | −1 |
| Fixed outer | 0 | 0 | 1 | −1 | 1 |
| Moving inner | 1 | 1 | 0 | 1 | −1 |
| Moving outer | 0 | 1 | 0 | 1 | 1 |

21. A fixed scroll member and a movable scroll member as claimed in claim 15, further comprising a crank and slider linkage operatively connected between said fixed scroll member and said movable scroll member to restrict relative rotation of said scroll members to a limited predetermined amount.

22. A scroll-type machine comprising:

a fixed scroll member having a fixed spiral wrap, the profiles of the inner and outer flanks of said fixed wrap each being the involute of the same generating plane geometric shape;

the center of said generating shape of the profile of said outer flank of said fixed wrap being displaced from the center of said generating shape of the profile of said inner flank of said fixed wrap;

a second scroll member having a second spiral wrap, said second wrap being intermeshed with said first wrap so that when said wraps are moved relative to one another along a predetermined path fluid pockets of progressively changing volume are formed; and means for causing said relative movement along said predetermined path.

23. A scroll-type machine as claimed in claim 22, wherein said plane geometric shape is a circle.

24. A scroll-type machine comprising:

a first scroll member having a first spiral wrap;

a second scroll member having a second spiral wrap and being mounted for movement with respect to said first scroll member, said second wrap being intermeshed with said first wrap so that when said second wrap is moved with respect to said first wrap along a predetermined path, fluid pockets of progressively changing volume are formed; and means for causing said second wrap to move along said predetermined path, including:

drive means for causing a first point on said second scroll member to move in a generally circular orbital path with respect to said first scroll member, and rotation controlling means for restricting rotational movement of said second scroll member by limiting movement of a second point thereon to a substantially straight line path with respect to said first scroll member, at least one of said wraps being of non-uniform thickness throughout its length so that a seal is achieved between said wraps in all relative positions thereof.

25. A scroll-type machine as claimed in claim 24, wherein said straight line path extends generally radially with regard to said second spiral wrap.

26. A scroll-type machine as claimed in claim 24, wherein said straight line path is slightly arcuate.

27. A scroll-type machine as claimed in claim 24, wherein said straight line path is a true straight line.

28. A scroll-type machine as claimed in claim 24, wherein said first point is disposed at the center of said second spiral wrap.

29. A scroll-type machine as claimed in claim 24, wherein said second point is disposed radially outwardly of said second spiral wrap.

30. A scroll-type machine as claimed in claim 29, wherein said first point is disposed at the center of said second spiral wrap.

31. A scroll-type machine as claimed in claim 24, wherein each of said spiral wraps has an inner and outer flank having a profile which is the involute of a circle.

32. A scroll-type machine comprising:

a first scroll member having a first spiral wrap, the profiles of the inner and outer flanks of said first wrap each being the involute of a plane geometric shape;

a second scroll member having a second spiral wrap and being mounted for movement with respect to said first scroll member, the profiles of the inner and outer flanks of said second wrap each being the involute of a plane geometric shape;

said second wrap being intermeshed with said first wrap so that when said second wrap is moved with respect to said first wrap along a predetermined path fluid pockets of progressively changing volume are formed; and means for causing said second wrap to move along said predetermined path, including rotation controlling means for restricting rotational movement of said second scroll member with respect to said first scroll member by limiting it to a predetermined amount, the centers of the generating shapes of the profiles of the flanks of one of said wraps being displaced from one another a sufficient distance to accommodate said predetermined amount of rotation and maintain sealing contact between said intermeshed wraps in all operative relative positions thereof.

33. A scroll-type machine as claimed in claim 32, wherein both said geometric shapes are generating circles.

34. A scroll-type machine as claimed in claim 32, wherein the centers of the generating shapes of the profiles of both flanks of both of said wraps are displaced from one another a sufficient distance to accommodate said predetermined amount of rotation and maintain sealing contact between said intermeshed wraps in all operative relative positions thereof.

35. A scroll-type machine as claimed in claim 34, wherein both said geometric shapes are generating circles.

36. A scroll-type machine as claimed in claim 35, wherein said rotation controlling means is connected to said second scroll member at substantially a single point.

37. A scroll-type machine as claimed in claim 36, wherein said centers are displaced from one another substantially along a line normal to a line extending between said single point and the center of said second wrap when said scroll members are not rotated relative to one another.

38. A scroll-type machine as claimed in claim 37, wherein the center of said second wrap moves in a circular orbit and said circles are of equal radius and displaced from one another by an amount equal to EC/L, where:

E=the radius of orbit of said second wrap;

C=the radius of said generating circle

L=the distance from the center of said second wrap to said single point.

39. A scroll-type machine as claimed in claim 32, wherein said rotation controlling means is connected to said second scroll member at substantially a single point and said centers are displaced from one another substantially along a line normal to a line extending between said single point and the center of said second wrap when said scroll members are not rotated relative to one another.

40. A scroll-type machine comprising:

a first scroll member having a first spiral wrap, the profiles of the inner and outer flanks of said first wrap each being the involute of a circle;

a second scroll member having a second spiral wrap and being mounted for movement with respect to said first scroll member, the profiles of the inner and outer flanks of said second wrap each being the involute of a circle;

said second wrap being intermeshed with said first wrap so that when said second wrap is moved with respect to said first wrap along a predetermined path fluid pockets of progressively changing volume are formed; and means for causing said second wrap to move along said predetermined path, including drive means for causing a first point on said second scroll member to move in a generally circular orbital path with respect to said first scroll member, and rotation controlling means for restricting rotational movement of said second scroll member by limiting movement of a second point thereon to a substantially straight line path with respect to said first scroll member, the centers of the generating circles of the profiles of the flanks of one of said wraps being displaced from one another a sufficient distance to accommodate said predetermined amount of rotation and maintain sealing contact between said intermeshed wraps in all operative relative positions thereof.

41. A scroll-type machine as claimed in claim 40, wherein said centers are displaced from one another substantially along a line normal to a line extending between said second point and the center of said second wrap when said scroll members are not rotated relative to one another.

42. A scroll-type machine as claimed in claim 41, wherein said circles are of equal radius and displaced from one another on each said wrap by an amount equal to EC/L, where:

E=the radius of orbit;

C=the radius of said base generating circle

L=the distance from the geometric center of said second wrap to said second point.

43. A scroll-type machine as defined by claim 24 further comprising:

said first scroll member having a first flat sealing surface and said first spiral wrap having a first flat tip surface;

said second scroll member having a second flat sealing surface and said second spiral wrap having a second flat tip surface, said first tip surface sealingly engaging said second sealing surface and said second tip surface sealingly engaging said first sealing surface to seal said pockets, each of said wraps being arranged so that the outside flank on the outer terminal end portion thereof does not engage the flank of the other wrap, said terminal end portion of each said wrap being substantially thicker in the radial direction than the remainder thereof in order to bear a disproportionately large share of the axial loads on said scroll members.

44. A scroll-type machine as claimed in claim 43, further comprising an oil supply groove in one of said tip surfaces, and means for supplying oil thereto in order to reduce friction.

45. A scroll-type machine as claimed in claim 43, further comprising means for supplying lubricating oil to at least one of said sealing surfaces in an area where it is engaged by a tip surface.

46. A scroll-type machine as claimed in claim 43, wherein both of said tip surfaces of each of said wraps lie in parallel planes.

47. A scroll-type machine is claimed in claim 43, wherein at least one of said terminal end portions extends for approximately 180°.

48. A scroll-type machine as claimed in claim 43, wherein both of said terminal end portions extend for approximately 180°.

49. A scroll-type machine as claimed by claim 24 further comprising:

a fixed support structure;

a thrust bearing operatively disposed between said fixed support structure and said second scroll member, said thrust bearing being generally annular in plan and having a parallel flat uninterrupted bearing surface on the face thereof facing said fixed support structure;

lubricating means for supplying oil to the interface between said thrust bearing and said fixed support structure to create an oil film therebetween;

whereby the resultant miniscule wobbling of said moving scroll member causing a squeeze film phenomenon between said thrust bearing and said fixed support structure.

50. A scroll-type machine as claimed in claim 49, wherein said thrust bearing is fixed to said moving scroll member.

51. A scroll type machine comprising:

a fixed scroll member having a first spiral wrap;

a movable scroll member having a second spiral wrap and being mounted for movement with respect to said fixed scroll member, a crankshaft driven for rotation about a first axis, said crankshaft having an axial bore a portion of which defines a cylindrical driving surface having an axis of curvature parallel to said first axis;

a drive element having an inner bore and having a cylindrical driven surface in driving engagment with said driving surface;

a hub on said movable scroll member having a cylindrical outer surface journalled onto said drive element inner bore for rotation with respect thereto about a third axis spaced from and parallel to said first axis, whereby rotation of said crankshaft causes said third axis on said movable scroll member to orbit relative to said fixed scroll member about said first axis; and rotation controlling means for restricting rotational movement of said second scroll member with respect to said first scroll member by limiting it to a predetermined amount.

52. A scroll-type machine as claimed in claim 51, wherein said driving surface axis of curvature is spaced from said first axis.

53. A scroll-type machine as claimed in claim 51, wherein said driving surface axis of curvature is spaced from said third axis.

54. A scroll-type machine as claimed in claim 51, wherein said driving and driven surfaces having a common axis of curvature.

55. A scroll-type machine as claimed in claim 51, wherein said first axis is spaced from said axis of curvature a greater distance than from said third axis.

56. A scroll-type machine as claimed in claim 51, wherein said axis of curvature is spaced from the plane of said first and third axes.

57. A scroll-type machine as claimed in claim 51, wherein said drive element is free to rotate with respect to said crankshaft about said axis of curvature in the event an obstruction temporarily prevents said moving scroll member from following its normal course of movement.

58. A scroll-type machine as claimed in claim 51, wherein said driving surface is disposed in the side wall of a recess in the end of said crankshaft.

59. A scroll-type machine as claimed in claim 51, wherein said driven means is a hub extending from said movable scroll member.

60. A scroll-type machine as claimed in claim 51, wherein said drive element is generally annular in cross-section.

61. A scroll-type mchine as claimed in claim 60, wherein said driven surface is disposed on the outer periphery of said drive element.

62. A scroll-type machine as claimed in claim 51, further comprising a fixed support structure having a bearing journaling one end of said crankshaft, said driving surface being radially aligned with said bearing.

63. A scroll-type machine as claimed in claim 62, wherein said bearing surrounds said driving surface.

64. A scroll-type machine as claimed in claim 51, wherein said drive element is generally cylindrical and said driven surface is disposed on the outer periphery thereof.

65. A scroll-type machine comprising:

a first scroll member having a first spiral wrap, the profiles of the inner and outer flanks of said first wrap each being the involute of the same generating plane geometric shape;

the center of said generating shape of the profile of said outer flank of said first wrap being displaced from the center of said generating shape of the profile of said inner flank of said first wrap;

a second scroll member having a second spiral wrap, said second wrap being intermeshed with said first wrap so that when said wraps are moved relative to one another along a predetermined path fluid pockets of progressively changing volume are formed; and means for causing said relative movement along said predetermined path.

66. A scroll-type machine as claimed in claim 65, wherein said plane geometric shape is a circle.

67. A scroll-type machine as claimed in claim 65, wherein said first and second wraps have the same flank profiles.

68. In a scroll-type machine, a coupling means to couple an orbiting scroll member and a stationary scroll member in predetermined angular relationship in all relative positions as said orbiting scroll member is orbited with respect to said stationary scroll member, comprising linkage operative to pivotally interconnect said orbiting scroll and said stationary scroll whereby said orbiting scroll is allowed to undergo slight angular excursions as it is driven to orbit said stationary scroll, said orbiting and said stationary scrolls being configured to maintain a plurality of sealing line contacts at all times during said slight angular excursions of said orbiting scroll.

69. A scroll-type machine comprising:

a first scroll member having a first spiral wrap with inner and outer flanks having a profile which is the involute of a circle;

a second scroll member having a second spiral wrap with inner and outer flanks having a profile which is the involute of a circle and being mounted for movement with respect to said first scroll member, said second wrap being intermeshed with said first wrap so that when said second wrap is moved with respect to said first wrap along a predetermined path, fluid pockets of progressively changing volume are formed and wherein the center of the generating base circle for the involute profile of the outer flank of one of said wraps is displaced from the center of the generating base circle for the involute profile of the inner flank of the same wrap; and means for causing said second wrap to move along said predetermined path, including:

drive means for causing a first point on said second scroll member to move in a generally circular orbital path with respect to said first scroll member, and rotation controlling means for restricting rotational movement of said second scroll member by limiting movement of a second point thereon to a substantially straight line path with respect to said first scroll member.

70. A scroll-type machine comprising:

a first scroll member having a first spiral wrap with inner and outer flanks having a profile which is the involute of a circle;

a second scroll member having a second spiral wrap with inner and outer flanks having a profile which is the involute of a circle and being mounted for movement with respect to said first scroll member, said second wrap being intermeshed with said first wrap so that when said second wrap is moved with respect to said first wrap along a predetermined path, fluid pockets of progressively changing volume are formed and wherein the center of the generating base circle for the involute profile of the outer flank of both of said wraps is displaced from the center of the generating base circle for the involute profile of the inner flank of the same wrap; and means for causing said second wrap to move along said predetermined path, including:

drive means for causing a first point on said second scroll member to move in a generally circular orbital path with respect to said first scroll member, and rotation controlling means for restricting rotational movement of said second scroll member by limiting movement of a second point thereon to a substantially straight line path with respect to said first scroll member.

71. A scroll-type machine comprising:

a first scroll member having a first spiral wrap, the profiles of the inner and outer flanks of said first wrap each being the involute of a plane geometric shape;

a second scroll member having a second spiral wrap and being mounted for movement with respect to said first scroll member, the profiles of the inner and outer flanks of said second wrap each being the involute of a plane geometric shape;

said second wrap being intermeshed with said first wrap so that when said second wrap is moved with respect to said first wrap along a predetermined path, fluid pockets of progressively changing volume are formed; and means for causing said second wrap to move along said predetermined path, including:

rotation controlling means for restricting rotational movement of said second scroll member with respect to said first scroll member by limiting it to a predetermined amount, the centers of the generating shapes of the profiles of the flanks of both of said wraps being displaced from one another a sufficient distance to accommodate said predetermined amount of rotation and maintain sealing contact between said intermeshed wraps in all operative relative positions thereof, the amount of displacement of the center of the generating shapes of the profiles of said wraps being governed by the following relationship:

displacement of the center of the generating shape of said first scroll wrap outer flank=(X) (Rmax)

displacement of the center of the generating shape of said second scroll wrap inner flank=(1-X) (Rmax)

displacement of the center of the generating shape of said first scroll wrap inner flank=(Y) (Rmax)

displacement of the center of the generating shape of said second scroll wrap outer flank=(1-Y) (Rmax)

where

X is the percentage proportion of displacement desired on the outer flank of the first scroll wrap, Y is the percentage proportion of displacement desired on the inner flank of the first scroll wrap, and (Rmax) is the maximum distance to accommodate said predetermined amount of rotation of said second scroll member with respect to said first scroll member.

* * * * *

UNITED STATES PATENT AND TRADEMARK OFFICE

CERTIFICATE OF CORRECTION

PATENT NO. : 4,609,334

DATED : September 2, 1986

INVENTOR(S) : Earl B. Muir et al

It is certified that error appears in the above-identified patent and that said Letters Patent is hereby corrected as shown below:

Column 1, line 65, "any" should be -- an --.

Column 2, line 4, "at" should be -- of --.

Column 2, line 34, delete "a".

Column 4, line 46, "." should be -- ; --.

Column 6, line 32, "oribitng" should be -- orbiting --.

Column 6, line 37, "oribiting" should be -- orbiting --.

Column 8, line 27, "enlongated" should be -- elongated --.

Column 10, line 15, "examplary" should be -- exemplary --.

Column 10, line 34, "surface" should be -- surfaces --.

Column 13, line 52, "Am = sin (Am) = (E sin(VTm (radians" should be --

$$Am = \sin(Am) = \frac{E \sin(VTm)}{L} \text{ (radians)}$$

--.

Column 14, line 54, "an" should be -- and --.

Column 14, line 68, "on" should be -- one --.

Column 15, line 41, "the" should be -- this --.

Column 15, line 48, after "is" insert -- no --.

Column 16, line 30, "or" should be -- on --.

UNITED STATES PATENT AND TRADEMARK OFFICE

CERTIFICATE OF CORRECTION

PATENT NO. : 4,609,334

DATED : September 2, 1986

INVENTOR(S) : Earl B. Muir et al

It is certified that error appears in the above-identified patent and that said Letters Patent is hereby corrected as shown below:

Column 17, line 42, "22" should be -- > --.

Column 17, line 44, "bb" should be -- Bb --.

Column 18, line 1, before "Ar" insert -- If --.

Column 20, line 39, "1" should be -- 6 --.

Column 20, line 42, "1" should be -- 6 --.

Column 20, line 67, delete "of" (third occurrence).

Column 21, line 3, "1" should be -- 6 --.

Column 21, line 8, "betwen" should be -- between --.

Column 21, line 41, delete "Am = arcsin ([E/L]sin(Ac))".

Column 22, line 46, "F11 =F12= 1" should be --F11 = F12 = 1 --.

Column 23, line 35, delete "said" (second occurrence).

Column 25, line 35, after "1" insert -- . --.

Column 25, line 40, delete "said" (second occurrence).

Column 25, line 57, "AC" should be -- Ac --.

Column 25, line 61, "AC" should be -- Ac --.

Column 26, line 43, after "angle" insert -- (i.e., -- .

UNITED STATES PATENT AND TRADEMARK OFFICE

CERTIFICATE OF CORRECTION

PATENT NO. : 4,609,334

DATED : September 2, 1986

INVENTOR(S) : Earl B. Muir et al

It is certified that error appears in the above-identified patent and that said Letters Patent is hereby corrected as shown below:

Column 26, line 59, after "1" insert -- . --.

Column 31, line 19, "mchine" should be -- machine --.

Column 31, line 60, after "linkage" insert -- means --.

Signed and Sealed this

Twenty-first Day of December, 1993

*Attest:*

Bruce Lehman

BRUCE LEHMAN

*Attesting Officer*

*Commissioner of Patents and Trademarks*